US008371685B2

(12) United States Patent
Kusunoki et al.

(10) Patent No.: US 8,371,685 B2
(45) Date of Patent: Feb. 12, 2013

(54) INKJET HEAD AND INKJET RECORDING METHOD

(75) Inventors: Naoki Kusunoki, Kanagawa-ken (JP); Tsutomu Yokouchi, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 238 days.

(21) Appl. No.: 12/656,882

(22) Filed: Feb. 18, 2010

(65) Prior Publication Data

US 2010/0214334 A1 Aug. 26, 2010

(30) Foreign Application Priority Data

Feb. 23, 2009 (JP) ..... 2009-039725

(51) Int. Cl.
*B41J 2/18* (2006.01)

(52) U.S. Cl. ..... 347/89; 347/17; 347/71

(58) Field of Classification Search ..... 347/5, 9, 347/10, 11, 71, 89, 17
See application file for complete search history.

(56) References Cited

U.S. PATENT DOCUMENTS

| | | | | |
|---|---|---|---|---|
| 6,217,159 | B1 * | 4/2001 | Morikoshi et al. | 347/71 |
| 2006/0007260 | A1 | 1/2006 | Oku | |
| 2008/0079759 | A1 | 4/2008 | Nagashima | |
| 2008/0238980 | A1 * | 10/2008 | Nagashima et al. | 347/17 |

FOREIGN PATENT DOCUMENTS

| | | | |
|---|---|---|---|
| JP | 2006-021388 | A | 1/2006 |
| JP | 2008-087288 | A | 4/2008 |
| JP | 2008-254196 | A | 10/2008 |

* cited by examiner

*Primary Examiner* — Lam S Nguyen
(74) *Attorney, Agent, or Firm* — Jean C. Edwards, Esq.; Edwards Neils PLLC

(57) ABSTRACT

An inkjet head includes: a pressure chamber; an actuator which expands and contracts volume of the pressure chamber; an ink supply flow channel; an individual supply flow channel having one end connected to the ink supply flow channel and another end connected to the pressure chamber, for guiding ink from the ink supply flow channel to the pressure chamber; a nozzle which ejects the ink; a nozzle flow channel having one end connected to the pressure chamber and another end connected to the nozzle, for guiding the ink from the pressure chamber to the nozzle; an ink recovery flow channel; an individual recovery flow channel having one end connected to the nozzle flow channel at a prescribed connection position set at an intermediate point of the nozzle flow channel and another end connected to the ink recovery flow channel, for guiding the ink from the nozzle flow channel to the ink recovery flow channel; an ink flow generation device which generates a flow of the ink from the nozzle flow channel toward the individual recovery flow channel; and a control device which controls driving of the actuator so as to drive the actuator in such a manner that, when performing ejection, volume of the pressure chamber contracts and thereby the ink is caused to be ejected from the nozzle, and when not performing the ejection, the volume of the pressure chamber expands and thereby a meniscus position of the ink is caused to be withdrawn to a vicinity of the prescribed connection position.

10 Claims, 22 Drawing Sheets

INKJET HEAD AND INKJET RECORDING METHOD

CROSS-REFERENCE TO RELATED APPLICATIONS

The present application claims priority from Japanese Patent Application No. 2009-039725, filed Feb. 23, 2009, the contents of which are herein incorporated by reference in their entirety.

BACKGROUND OF THE INVENTION

1. Field of the Invention

The present invention relates to an inkjet head and an inkjet recording method, and more particularly, to an inkjet head and an inkjet recording method in which ink is circulated during supply.

2. Description of the Related Art

If an inkjet head halts an ejection operation during a prescribed period of time, then due to evaporation of the solvent component, the ink inside the nozzles increases in viscosity locally and ejection defects occur.

Consequently, in an inkjet recording apparatus based on a shuttle method, increase in the viscosity of the ink inside the nozzles is prevented by purging (carrying out dummy ejection) in a maintenance area outside the print area, during the printing operation of one sheet.

However, in a line-type of inkjet recording apparatus, there is a tendency for ejection defects to occur readily because it is not possible to carry out purging during the printing operation of one sheet, as in a shuttle-type of inkjet recording apparatus.

Therefore, Japanese Patent Application Publication No. 2008-87288 discloses a method for preventing increase in the viscosity of ink in a line-type of inkjet head, by providing a circulation channel in the vicinity of the nozzles, in the nozzle flow channels which connect nozzles with pressure chambers, and by causing the ink to circulate through this circulation channel at all times.

However, according to the method according to Japanese Patent Application Publication No. 2008-87288, the circulation of ink is insufficient in the portion of the nozzle flow channel that is situated in the position anterior to the portion which connects to the circulation channel, and therefore the increase in the viscosity of the ink is not sufficiently prevented.

Furthermore, according to Japanese Patent Application Publication No. 2008-87288, meniscus shaking is performed in order to remove air bubbles in the ink inside the nozzle flow channel, but the relationship between the amplitude of the meniscus shaking and the position of the nozzle flow channel is not considered, and if the amplitude of the meniscus shaking is not set appropriately, then there is a possibility that the increase in the viscosity of the stagnant ink in the vicinity of the nozzles cannot be eliminated completely.

SUMMARY OF THE INVENTION

The present invention has been contrived in view of these circumstances, an object thereof being to provide an inkjet head and an inkjet recording method whereby increase in the viscosity of the ink inside a nozzle can be prevented.

In order to attain an object described above, one aspect of the present invention is directed to an inkjet head, comprising: a pressure chamber; an actuator which expands and contracts volume of the pressure chamber; an ink supply flow channel; an individual supply flow channel having one end connected to the ink supply flow channel and another end connected to the pressure chamber, for guiding ink from the ink supply flow channel to the pressure chamber; a nozzle which ejects the ink; a nozzle flow channel having one end connected to the pressure chamber and another end connected to the nozzle, for guiding the ink from the pressure chamber to the nozzle; an ink recovery flow channel; an individual recovery flow channel having one end connected to the nozzle flow channel at a prescribed connection position set at an intermediate point of the nozzle flow channel and another end connected to the ink recovery flow channel, for guiding the ink from the nozzle flow channel to the ink recovery flow channel; an ink flow generation device which generates a flow of the ink from the nozzle flow channel toward the individual recovery flow channel; and a control device which controls driving of the actuator so as to drive the actuator in such a manner that, when performing ejection, volume of the pressure chamber contracts and thereby the ink is caused to be ejected from the nozzle, and when not performing the ejection, the volume of the pressure chamber expands and thereby a meniscus position of the ink is caused to be withdrawn to a vicinity of the prescribed connection position.

According to this aspect of the invention, when performing ejection, the actuator is driven so as to contract the volume of the pressure chamber. By this means, the ink inside the pressure chamber is pushed out, passes along the nozzle flow channel and is ejected from the nozzle. On the other hand, when not performing ejection, the actuator is driven so as to expand the volume of the pressure chamber. By this means, when not performing ejection, the ink inside the nozzle flow channel is suctioned toward the inside of the pressure chamber, and the ink meniscus position is withdrawn to the vicinity of the connection position with the individual recovery flow channel. By withdrawing the ink meniscus position to the vicinity of the connection position with the individual recovery flow channel in this way, it is possible to prevent the stagnation of the ink (in particular, stagnation in the nozzle portion) and it is possible to prevent increase in the viscosity of the ink in the nozzle.

Desirably, the actuator is a piezoelectric element which displaces a wall of the pressure chamber in two directions so as to expand or contract the volume of the pressure chamber; and the control device drives the actuator by a first drive waveform signal to eject the ink from the nozzle when performing the ejection, and drives the actuator by a second drive waveform signal to withdraw the meniscus position of the ink to the vicinity of the prescribed connection position when not performing the ejection.

According to this aspect of the invention, the actuator is constituted by a piezoelectric element, which is driven by the first drive waveform and the second drive waveform, and causes the volume of the pressure chamber to expand or contract. In other words, when performing ejection, the actuator is driven by the first drive waveform and when not performing ejection, the actuator is driven by the second drive waveform, thereby causing the pressure chamber to expand (when performing ejection) or to contract (when not performing ejection). By this means, it is possible to control the operation in a simple fashion.

Desirably, the inkjet head further comprises an inner surface properties switching device which selectively switches inner surface properties of the nozzle flow channel in the vicinity of the connection position between hydrophobic and hydrophilic, wherein the control device controls the inner surface properties switching device in such a manner that the inner surface properties are switched to hydrophilic when performing the ejection and are switched to hydrophobic when not performing the ejection.

According to this aspect of the invention, it is possible to switch the inner surface properties of the nozzle flow channel in the vicinity of the connection position between hydrophobic and hydrophilic, and the inner surface properties are switched to hydrophilic when performing ejection and switched to hydrophobic when not performing ejection. By this means, it is possible stably to hold the meniscus position of the ink which has been withdrawn when not performing ejection. Furthermore, it is also possible to eject ink stably when performing ejection.

Desirably, the inner surface properties switching device comprises: a ring-shaped hydrophobic insulating body which constitutes an inner surface of the nozzle flow channel in the vicinity of the connection position; a ring-shaped electrode provided on an outer circumferential portion of the ring-shaped hydrophilic insulating body; and a voltage application device which applies voltage between the ink flowing in the nozzle flow channel and the electrode, wherein an inner surface of the ring-shaped hydrophobic insulating body becomes hydrophilic when the voltage application device applies the voltage between the ink and the electrode, and becomes hydrophobic when application of the voltage by the voltage application device is cancelled.

According to this aspect of the invention, the inner surface properties switching device which switches the inner surface properties of the nozzle flow channel in the vicinity of the connection position includes a ring-shaped hydrophobic insulating body, a ring-shaped electrode provided in the outer circumferential portion of same, and a voltage application device which applies a voltage between the electrode and the ink flowing in the nozzle flow channel. The inner surface properties of the nozzle flow channel in the vicinity of the connection position are made hydrophilic by applying a voltage between the ink and the electrode by means of the voltage application device, and are made hydrophobic when the application of the voltage is released. By this means, it is possible to perform the switch between hydrophobic and hydrophilic properties, in a simple fashion.

Desirably, the ink in the ink supply flow channel is supplied from an ink tank; the ink in the ink recovery flow channel is recovered to the ink tank; and the ink flow generation device circulates the ink so as to generate the flow of the ink from the nozzle flow channel toward the individual recovery flow channel.

According to this aspect of the invention, ink is supplied from an ink tank to a supply flow channel, and the ink is recovered from a recovery flow channel to the ink tank. In other words, the ink is supplied by circulation. By circulating the ink in this way, a flow of ink is created from the nozzle flow channel toward the individual recovery flow channel.

In order to attain an object described above, another aspect of the present invention is directed to an inkjet head, comprising: a pressure chamber; an ejection actuator which changes pressure in the pressure chamber; an ink supply flow channel; an individual supply flow channel having one end connected to the ink supply flow channel and another end connected to the pressure chamber, for guiding ink from the ink supply flow channel to the pressure chamber; a nozzle which ejects ink; a nozzle flow channel having one end connected to the pressure chamber and another end connected to the nozzle, for guiding the ink from the pressure chamber to the nozzle; an ink recovery flow channel; an individual recovery flow channel having one end connected to the nozzle flow channel at a prescribed connection position set at an intermediate point of the nozzle flow channel and another end connected to the ink recovery flow channel, for guiding the ink from the nozzle flow channel to the ink recovery flow channel; an ink flow generation device which generates a flow of the ink from the nozzle flow channel to the individual recovery flow channel; and a suction chamber which is provided at an intermediate point of the individual recovery flow channel; a suctioning actuator which expands volume of the suction chamber; and a control device which controls driving of the suctioning actuator so as to drive the suctioning actuator in such a manner that, when not performing ejection, the volume of the suction chamber is expanded to withdraw a meniscus position of the ink to a vicinity of the prescribed connection position.

According to this aspect of the invention, when performing ejection, the ejection actuator is driven and ink is ejected from the nozzle. On the other hand, when not performing ejection, the suctioning actuator is driven and the ink inside the nozzle flow channel is drawn inside the individual recovery flow channel, as a result of which the ink meniscus position is withdrawn to the vicinity of the connection position with the individual recovery flow channel. By withdrawing the ink meniscus position to the vicinity of the connection position with the individual recovery flow channel in this way, it is possible to prevent the stagnation of the ink (in particular, stagnation in the nozzle portion) and it is possible to prevent increase in the viscosity of the ink in the nozzle.

Desirably, the inkjet head further comprises an inner surface properties switching device which selectively switches inner surface properties of the nozzle flow channel in the vicinity of the connection position between hydrophobic and hydrophilic, wherein the control device controls the inner surface properties switching device in such a manner that the inner surface properties are switched to hydrophilic when performing the ejection and are switched to hydrophobic when not performing the ejection.

According to this aspect of the invention, the inner surface properties switching device which switches the inner surface properties of the nozzle flow channel in the vicinity of the connection position includes a ring-shaped hydrophobic insulating body, a ring-shaped electrode provided in the outer circumferential portion of same, and a voltage application device which applies a voltage between the electrode and the ink flowing in the nozzle flow channel. The inner surface properties of the nozzle flow channel in the vicinity of the connection position are made hydrophilic by applying a voltage between the ink and the electrode by means of the voltage application device, and are made hydrophobic when the application of the voltage is released. By this means, it is possible to perform the switch between hydrophobic and hydrophilic properties, in a simple fashion.

Desirably, the inner surface properties switching device comprises: a ring-shaped hydrophobic insulating body which constitutes an inner surface of the nozzle flow channel in the vicinity of the connection position; a ring-shaped electrode provided on an outer circumferential portion of the ring-shaped hydrophilic insulating body; and a voltage application device which applies voltage between the ink flowing in the nozzle flow channel and the electrode, wherein an inner surface of the ring-shaped hydrophobic insulating body becomes hydrophilic when the voltage application device applies the voltage between the ink and the electrode, and becomes hydrophobic when application of the voltage by the voltage application device is cancelled.

According to this aspect of the invention, the inner surface properties switching device which switches the inner surface properties of the nozzle flow channel in the vicinity of the connection position includes a ring-shaped hydrophobic insulating body, a ring-shaped electrode provided in the outer circumferential portion of same, and a voltage application device which applies a voltage between the electrode and the ink flowing in the nozzle flow channel. The inner surface properties of the nozzle flow channel in the vicinity of the connection position are made hydrophilic by applying a voltage between the ink and the electrode by means of the voltage application device, and are made hydrophobic when the application of the voltage is released. By this means, it is possible to perform the switch between hydrophobic and hydrophilic properties, in a simple fashion.

Desirably, the ejection actuator is a piezoelectric element which deforms a wall of the pressure chamber in one direction to expand volume of the pressure chamber; and the suctioning actuator is a piezoelectric element which deforms a wall of the suction chamber in one direction to contract the volume of the suction chamber.

According to this aspect of the invention, the ejection actuator is constituted by a piezoelectric element, which deforms a wall of the pressure chamber in one direction and contracts the volume of the pressure chamber. By this means, the pressure inside the pressure chamber is changed and ink is ejected from the nozzle. Similarly, the suctioning actuator is also constituted by a piezoelectric element, which deforms a wall of the suction chamber in one direction and expands the volume of the suction chamber. By this means, ink inside the nozzle flow channel is pulled into the individual recovery flow channel and the ink meniscus position is withdrawn to the vicinity of the connection position. By causing the actuators to deform in one direction only in this way, it is possible to reduce the load and to improve the durability of the head.

Desirably, the ink in the ink supply flow channel is supplied from an ink tank; the ink in the ink recovery flow channel is recovered to the ink tank; and the ink flow generation device circulates the ink so as to generate the flow of the ink from the nozzle flow channel toward the individual recovery flow channel.

According to this aspect of the invention, ink is supplied from an ink tank to a supply flow channel, and the ink is recovered from a recovery flow channel to the ink tank. In other words, the ink is supplied by circulation. By circulating the ink in this way, a flow of ink is created from the nozzle flow channel toward the individual recovery flow channel.

In order to attain an object described above, another aspect of the present invention is directed to an inkjet recording method comprising ejecting ink from a nozzle while generating a flow of the ink from a nozzle flow channel which guides the ink from a pressure chamber to the nozzle, toward an individual recovery flow channel which connects with an intermediate point of the nozzle flow channel, in such a manner that an image is recorded, wherein, when not performing ejection, a meniscus position of the ink is withdrawn to a vicinity of a connection position with the individual recovery flow channel.

According to this aspect of the invention, in a case where ink is ejected while generating a flow of ink from the nozzle flow channel toward the individual recovery flow channel, the ink meniscus position is withdrawn to the vicinity of the connection position with the individual recovery flow channel, when not performing ejection. Consequently, it is possible to prevent stagnation of ink (in particular, stagnation in the nozzle portion), and therefore increase in the viscosity of the ink inside the nozzle can be prevented.

Desirably, inner surface properties of the nozzle flow channel in the vicinity of the connection position with the individual recovery flow channel are configured to be switchable between hydrophobic and hydrophilic, and are switched to hydrophilic when performing ejection and to hydrophobic when not performing the ejection.

According to this aspect of the invention, it is possible to switch the inner surface properties of the nozzle flow channel in the vicinity of the connection position with the individual recovery flow channel between hydrophobic and hydrophilic, and the inner surface properties are switched to hydrophilic when performing ejection and switched to hydrophobic when not performing ejection. By this means, it is possible stably to hold the meniscus position of the ink which has been withdrawn when not performing ejection. Furthermore, it is also possible to eject ink stably when performing ejection.

According to the present invention, it is possible to prevent increase in the viscosity of the ink inside a nozzle and it is possible to prevent the occurrence of ejection defects.

DETAILED DESCRIPTION OF THE PREFERRED EMBODIMENTS

Composition of Inkjet Recording Apparatus

Figure 1:
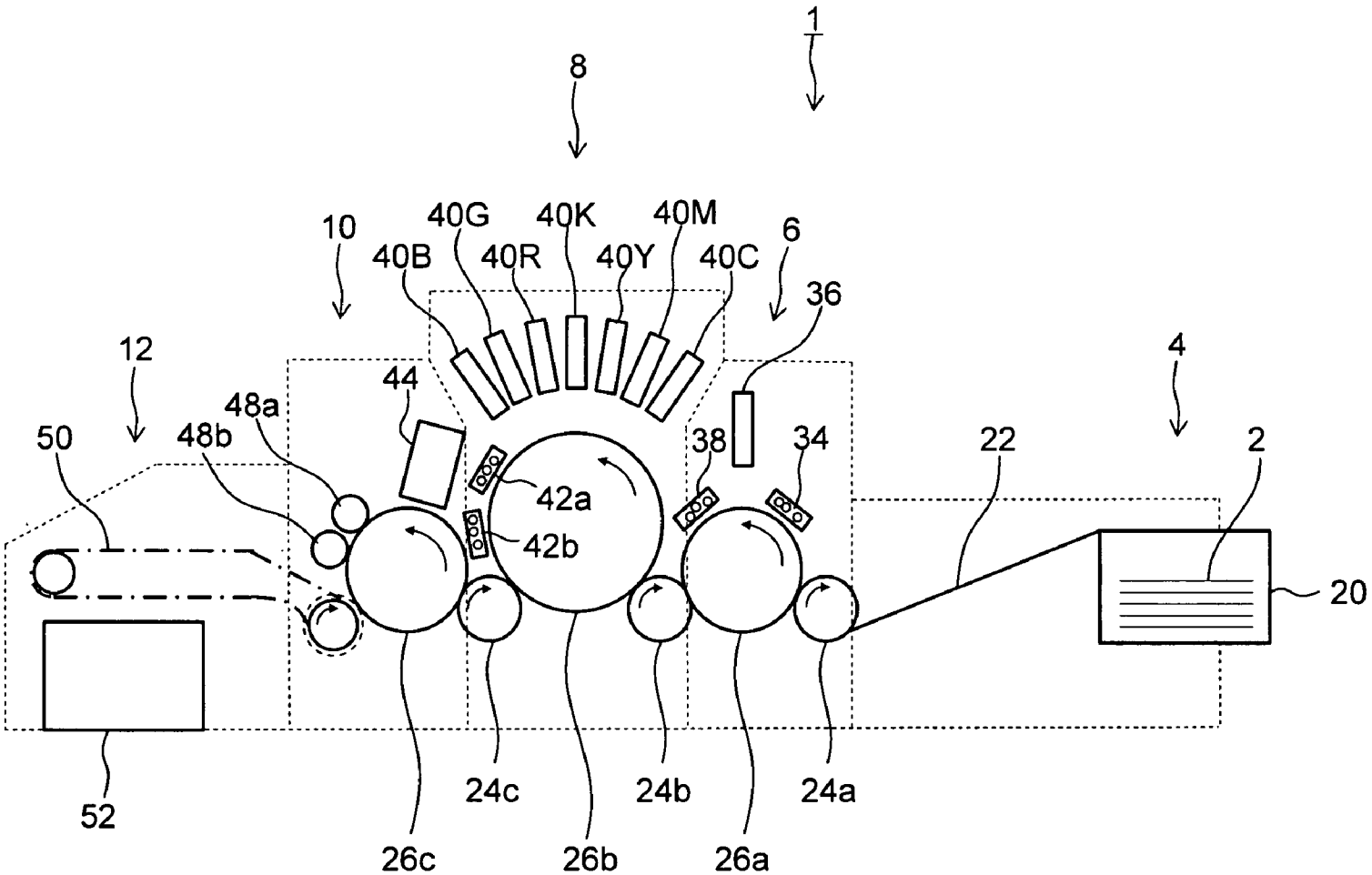
FIG. 1 is a general schematic drawing illustrating one example of an inkjet recording apparatus.

FIG. 1 is a general schematic drawing illustrating one example of an inkjet recording apparatus to which an embodiment of the present invention is applied. The inkjet recording apparatus 1 is constituted by an on-demand printing machine which records images by using cut printing paper, and principally comprises: a paper supply unit which supplies paper 2; a treatment liquid deposition unit 6 which deposits a prescribed treatment liquid on the paper 2; a print unit 8 which ejects droplets of colored inks onto the paper 2; a fixing unit 10 which fixes an image formed on the paper 2; and a paper discharge unit 12 which conveys and outputs the paper 2 on which an image has been formed.

The recording paper may be categorized as non-coated paper and coated papers, depending on whether or not it has a coating member (kaolin-containing material, or the like), coating the paper in order to improve flatness and ink absorbing properties, or the like. Coated papers can be further classified as art papers, coating paper, medium-coated papers, and thin-coated papers, depending on the thickness of the coating. In the present embodiment, coated papers, and in particular, medium-coated papers are used. Furthermore, a composition is adopted which is capable of handling paper up to a maximum size of half Kiku size (a maximum paper size of 740×535 mm), in order to be compatible with on-demand printing applications.

Paper Supply Unit

A paper supply magazine 20 is provided in the paper supply unit 4, and cut paper 2 is accommodated in a stacked fashion in this paper magazine 20. The paper supply magazine 20 is connected to a feeder board 22, and paper 2 accommodated in the paper supply magazine 20 is sent out sequentially from the top, one sheet at a time, to the feeder board 22. The paper 2 which has been conveyed to the feeder board 22 is transferred via a transfer drum 24*a* to a pressure drum 26*a* of the treatment liquid deposition unit 6.

Treatment Liquid Deposition Unit

A pressure drum 26*a* is provided in the treatment liquid deposition unit 6, and a paper preheating unit 34, a treatment liquid deposition unit 36 and a treatment liquid drying unit 38 are provided in sequence about the outer circumferential surface of the pressure drum 26*a*.

The pressure drum 26*a* has a drum shape and rotates by being driven by a motor (not illustrated). A gripper (not illustrated) is provided on the outer circumferential surface of the pressure drum 26*a*, and the paper 2 is conveyed while the leading edge thereof is held by the gripper. Furthermore, a plurality of suction holes (not illustrated) are formed in the outer circumferential surface of the pressure drum 26*a*, and air is suctioned toward the interior of the drum via these suction holes. The paper 2 is conveyed while being suctioned and held via these suction holes.

The paper preheating unit 34 includes a warm air blower which blows a warm air flow that has been controlled to a prescribed temperature, toward the outer circumferential surface of the pressure drum 26*a*. When the paper 2 conveyed by rotation by the pressure drum 26*a* passes below the paper preheating unit 34, the warm air flow is blown onto the surface, which is thereby preheated.

The treatment liquid deposition unit 36 deposits a treatment liquid having a function of causing the coloring material in the ink to aggregate on the surface (image forming surface) of the paper 2 which is conveyed by rotation by the pressure drum 26*a*, to a uniform thickness. This treatment liquid deposition unit 36 includes an inkjet head (line head) having the same composition as the respective inkjet heads of the print unit 8, and ejects treatment liquid onto the paper 2 which is conveyed by rotation by the pressure drum 26*a* from the inkjet head, thereby depositing the treatment liquid to a uniform thickness on the surface of the paper 2.

The treatment liquid deposition method is not limited to this, and it is also possible, for example, to deposit treatment liquid by a spray method, a coating method or an application method, or the like.

The treatment liquid drying 38 includes a warm air blower which blows a warm air flow that has been controlled to a prescribed temperature, toward the outer circumferential surface of the pressure drum 26*a*. When the paper 2 conveyed by rotation by the pressure drum 26*a* passes below the treatment liquid drying unit 38, a warm air flow is blown onto the surface of the paper, and the treatment liquid ejected as droplets on the surface of the paper is dried.

According to the treatment liquid deposition unit 6 having the composition described above, paper 2 which has been transferred onto the pressure drum 26*a* from the feeder board 22 of the paper supply unit 4 via the transfer drum 24*a* is firstly passed below a paper preheating unit 34 by being conveyed by rotation by the pressure drum 26*a*. During this passage of the paper, a warm air flow is blown from the paper preheating unit 34, thereby preheating the paper. The preheated paper 2 then passes below the treatment liquid deposition unit 36, and during this passage, treatment liquid is deposited to a uniform thickness on the surface of the paper from the treatment liquid deposition unit 36. The paper 2 on which the treatment liquid has been deposited is finally passed through the treatment liquid drying unit 38, where a warm air flow is blown from a treatment liquid drying unit 38 during passage, and the treatment liquid deposited on the surface is dried. By this means, an aggregating treatment agent layer is formed on the surface of the paper 2.

The paper 2 on the surface of which an aggregating treatment agent layer has been formed by the treatment liquid deposition unit 6 is transferred to a pressure drum 26*b* of the print unit 8 via the transfer drum 24*b*.

Print Unit

A pressure drum 26*b* is provided in the print unit 8, in which, along the outer circumferential surface of the pressure drum 26*b*, an inkjet head 40C for ejecting cyan-colored (C) ink droplets, an inkjet head 40M for ejecting magenta-colored (M) ink droplets, an inkjet head 40Y for ejecting yellow-colored (Y) ink droplets, an inkjet head 40K for ejecting black-colored (K) ink droplets, an inkjet head 40R for ejecting red-colored (R) ink droplets, an inkjet head 40G for ejecting green-colored (G) ink droplets, an inkjet head 40B for ejecting blue-colored (B) ink droplets, and ink drying units 42*a* and 42*b*, are disposed in sequence.

The pressure drum 26*b* is formed in a drum shape similarly to the pressure drum 26*a* of the treatment liquid deposition unit 6, and is rotated by being driven by a motor (not illustrated). A gripper (not illustrated) is provided on the outer circumferential surface of the pressure drum 26*b*, and the paper 2 is conveyed while the leading edge thereof is held by the gripper. Furthermore, a plurality of suction holes (not illustrated) are formed in the outer circumferential surface of the pressure drum 26*b*, and air is suctioned toward the interior of the drum via these suction holes. The paper 2 is conveyed while being suctioned and held via these suction holes.

The respective inkjet heads 40C, 40M, 40Y, 40K, 40R, 40G and 40B are constituted by line heads corresponding to the paper width (in the present embodiment, half Kiku size), and the ink ejection surfaces thereof are disposed so as to oppose the outer circumferential surface of the pressure drum 26*b*. The nozzle row formed on the ink ejection surface is disposed in a direction perpendicular to the direction of rotation of the pressure drum 26*b* (namely, the direction of rotation of the paper 2).

When the paper 2 which is conveyed by rotation by the pressure drum 26*b* passes below the respective inkjet heads 40C, 40M, 40Y, 40K, 40R, 40G and 40B, ink droplets are ejected onto the whole area of the paper in the breadthways direction (the direction perpendicular to the conveyance direction), and by this means, an image is formed on the whole of the image forming area by one conveyance action (sub-scanning action).

The composition of the inkjet heads 40C, 40M, 40Y, 40K, 40R, 40G and 40B and the composition of the ink supply mechanism are described in detail below.

Each of the ink drying units 42*a* and 42*b* is constituted by a warm air blower which blows a warm air flow that has been controlled to a prescribed temperature, toward the outer circumferential surface of the pressure drum 26*b*. When the paper 2 conveyed by rotation by the pressure drum 26*b* passes below the ink drying units 42*a* and 42*b*, a warm air flow is blown onto the surface of the paper, and the ink ejected as droplets on the surface of the paper is dried.

According to the print unit 8 having this composition, the paper 2 transferred onto the pressure drum 26*b* from the pressure drum 26*a* of the treatment liquid deposition unit 6 via the transfer drum 24*b* is conveyed by rotation of the pressure drum 26*a*, whereby the paper is passed below the inkjet heads 40C, 40M, 40Y, 40K, 40R, 40G and 40B. During this passage of the paper, droplets of inks of colors are ejected respectively from the inkjet heads 40C, 40M, 40Y, 40K, 40R, 40G and 40B, thereby forming an image on the surface of the paper. The paper 2 on which an image has been formed passes below the ink drying units 42*a* and 42*b*, and during this passage, a warm air flow is blown onto the surface of the paper from the ink drying units 42*a* and 42*b*, thereby drying the ink droplets ejected onto the surface.

In the present embodiment, a composition is adopted in which an image is formed by using inks of seven colors of C, M, Y, K, R, G and B, but the number of combination of ink colors used are not limited to these. It is also possible to add light inks, dark inks, special color inks, or the like, according to requirements. For example, it is possible to adopt a composition which additionally comprises heads for ejecting light inks, such as light cyan, light magenta, and the like. Furthermore, it is also possible to use a composition based on the four colors of C, M, Y and K only.

The paper 2 on the surface of which an image has been formed by the print unit 8 is transferred to a pressure drum 26*c* of the fixing unit 10 via the transfer drum 24*c*.

Fixing Unit

A pressure drum 26*c* is provided in the fixing unit 10, and an image reading unit 44 and heating rollers 48*a* and 48*b* are provided in sequence from the upstream side in terms of the direction of rotation, about the outer circumferential surface of the pressure drum 26*c*.

The pressure drum 26*c* is formed in a drum shape similarly to the pressure drum 26*a* of the treatment liquid deposition unit 6, and is rotated by being driven by a motor (not illustrated). A gripper (not illustrated) is provided on the outer circumferential surface of the pressure drum 26*c*, and the paper 2 is conveyed while the leading edge thereof is held by the gripper. Furthermore, a plurality of suction holes (not illustrated) are formed in the outer circumferential surface of the pressure drum 26*a*, and air is suctioned toward the interior of the drum via these suction holes. The paper 2 is conveyed while being suctioned and held via these suction holes.

The image reading unit 44 is constituted by an image sensor (line sensor, or the like) which captures an image of the surface of the paper 2 which is conveyed by rotation by the pressure drum 26*c*. The image read by the image reading unit 44 is used to determine nozzle blockages in each inkjet head in the print unit 8 and other ejection defects.

The heating rollers 48*a* and 48*b* are controlled to a prescribed temperature and are abutted against and pressed against the outer circumferential surface of the pressure drum 26*c*. When the paper 2 conveyed by rotation by the pressure drum 26*c* is passed by the heating rollers 48*a* and 48*b*, the paper is heated and pressurized between the rollers and the pressure drum 26*c*, thereby fixing the image formed on the surface of the paper 2.

Desirably, the heating temperature of the heating rollers 48*a* and 48*b* is set in accordance with the glass transition temperature of the polymer micro-particles which are contained in the treatment liquid or the ink.

According to the fixing unit 10 having the composition described above, when the paper 2 which has been transferred to the pressure drum 26*c* from the pressure drum 26*b* of the print unit 8 via the transfer drum 24*c* is conveyed by rotation by the pressure drum 26*c*, the paper passes below the image reading unit 44 and during this passage, the image formed on the surface of the paper is read in, according to requirements. Thereupon, the paper 2 is heated and pressurized by the heating rollers 48*a* and 48*b*, whereby the image formed on the surface is fixed.

The paper 2 on which the image has been fixed by the fixing unit 10 is transferred onto a conveyor 50 of the paper discharge unit 12.

Paper Discharge Unit

The paper discharge unit 12 comprises a conveyor 50 which conveys paper 2, and a paper discharge magazine 52 which recovers the paper 2 conveyed by this conveyor 50.

The paper 2 on which the image has been fixed by the fixing unit 10 is transferred from the pressure drum 26*c* of the fixing unit 10 to the conveyor 50, and is conveyed to the paper discharge magazine 52 by this conveyor 50.

The paper discharge magazine 52 receives the paper 2 conveyed by the conveyor 50 and recovers the paper in a stacked state therein.

Composition of the Control System

Figure 2:
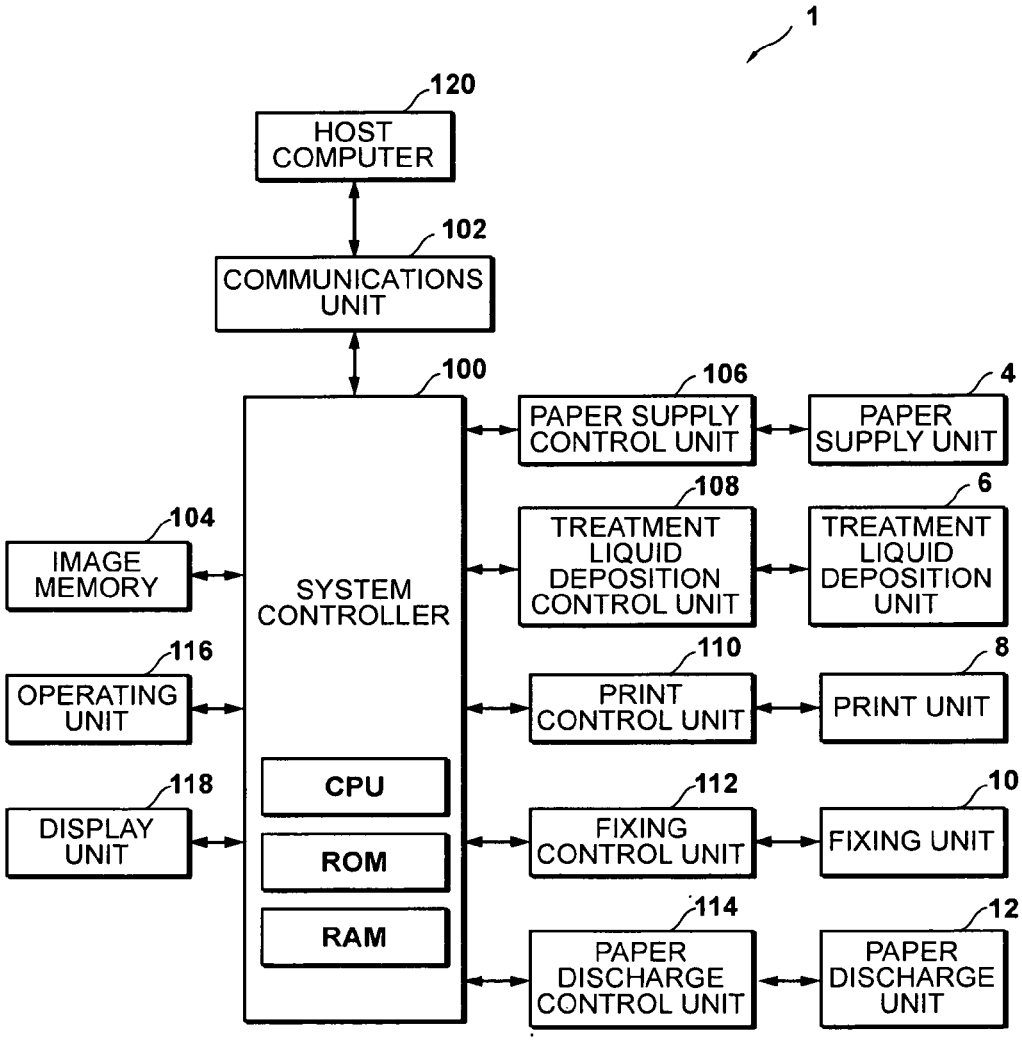
FIG. 2 is a block diagram illustrating the system composition of the control system of an inkjet recording apparatus.

FIG. 2 is a block diagram illustrating the approximate composition of a control system in the inkjet recording apparatus 1 according to the present embodiment.

As illustrated in FIG. 2, the inkjet recording apparatus 1 comprises a system controller 100, a communications unit 102, an image memory 104, a paper supply control unit 106, a treatment liquid deposition control unit 108, an ink droplet ejection control unit 110, a fixing control unit 112, a paper discharge control unit 114, an operating unit 116, a display unit 118, and the like.

The system controller 100 functions as a control device which controls the respective units of the inkjet recording apparatus 1, and also functions as a calculation device which carries out various calculation processes. This system controller 100 is constituted by a CPU, ROM, RAM, or the like, and operates in accordance with a prescribed control program. Control programs executed by the system controller 100 and various data required for control purposes are stored in a ROM.

The communications unit 102 comprises a required communications interface, and transmits and receives data to and from a host computer 120 connected to the communications interface.

The image memory 104 functions as a temporary storage device for various data including image data, and data is read and written via the system controller 100. Image data read in from the host computer 120 via the communications unit 102 is stored in this image memory 104.

The paper supply control unit 106 controls the driving of the respective units which constitute the paper supply unit 4 in accordance with instructions from the system controller 100.

The treatment liquid deposition control unit 108 controls the driving of the respective units which constitute the treatment liquid deposition unit 6 in accordance with instructions from the system controller 100.

The ink droplet ejection control unit 110 controls the driving of the respective units which constitute the print unit 8 in accordance with instructions from the system controller 100.

The fixing control unit 112 controls the driving of the respective units which constitute the fixing unit 10 in accordance with instructions from the system controller 100.

The paper discharge control unit 114 controls the driving of the respective units which constitute the paper discharge unit 12 in accordance with instructions from the system controller 100.

The operating unit 116 comprises a required operating device (for example, operating buttons, a keyboard, a touch panel, or the like), and the operating information input via this operating device is output to the system controller 100. The system controller 100 executes processing of various types in accordance with the operating information input from this operating unit 116.

The display unit 118 comprises a required display apparatus (for example, an LCD (liquid crystal display) panel, or the like), and the prescribed information is displayed on the display apparatus in accordance with an instruction from the system controller 100.

As described above, the image data recorded on the paper 2 is read into the inkjet recording apparatus 1 from the host computer 120 via the communications unit 102, and is stored in the image memory 104. The system controller 100 generates dot data by carrying out prescribed signal processing on the image data stored in the image memory 104, and controlling the driving of the respective ink heads of the print unit 8 in accordance with the generated dot data, whereby the image represented by the image data is recorded on the paper 2.

Dot data is generally created by subjecting the image data to color conversion processing and half-tone processing. Color conversion processing is processing for converting image data represented by sRGB or the like (for example, RGB 8-bit image data) to color data of the respective colors of the inks used by the inkjet recording apparatus 1 (in the present embodiment, color data for K, C, M, Y, R, G, and B). The halftone processing is processing for converting the color data of the respective colors generated by the color conversion processing into dot data of the respective colors (in the present embodiment, dot data for K, C, M, Y, R, G, B) by error diffusion processing, or the like.

The system controller 100 generates dot data for the respective colors of C, M, Y, K, R, G and B by carrying out color conversion processing and halftone processing of the image data. By controlling the driving of the corresponding ink heads in accordance with the dot data for the respective colors thus generated, an image represented by the image data is recorded on the paper 2.

Image Recording Operation

Next, an image recording operation performed by the inkjet recording apparatus 1 composed as described above will be explained.

Paper 2 accommodated in the paper supply magazine 20 is paid out sequentially from the top, one sheet at a time, to the feeder board 22, and is transferred from the feeder board 22 to the pressure drum 26*a* of the treatment liquid deposition unit 6 via the transfer drum 24*a*.

The paper 2 which has been transferred to the pressure drum 26*a* of the treatment liquid deposition unit 6 is conveyed by rotation by this pressure drum 26*a*, whereby the paper is firstly passed below the preheating unit 34. During this passage of the paper, a warm air flow is blown from the paper preheating unit 34, thereby preheating the paper. The preheated paper 2 then passes below the treatment liquid deposition unit 36, and during this passage, treatment liquid is deposited to a uniform thickness on the surface of the paper from the treatment liquid deposition unit 36. The paper 2 on which the treatment liquid has been deposited is finally passed through the treatment liquid drying unit 38, where a warm air flow is blown from the treatment liquid drying unit 38 during passage, and the treatment liquid deposited on the surface is dried. By this means, an aggregating treatment agent layer having a function for aggregating the ink coloring material is formed on the surface of the paper 2.

The paper 2 on the surface of which an aggregating treatment agent layer has been formed by the treatment liquid deposition unit 6 is transferred to the pressure drum 26*b* of the print unit 8 via the transfer drum 24*b*.

The paper 2 transferred to the pressure drum 26*b* of the print unit 8 is conveyed by rotation on the pressure drum 26*b* and is thereby passed below the respective inkjet heads 40C, 40M, 40Y, 40K, 40R, 40G and 40B. During this passage of the paper, droplets of inks of respective colors are ejected from the inkjet heads 40C, 40M, 40Y, 40K, 40R, 40G and 40B, thereby forming an image on the surface of the paper. The paper 2 on which an image has been formed passes below the ink drying units 42*a* and 42*b*, and during this passage, a warm air flow is blown onto the surface of the paper from the ink drying units 42*a* and 42*b*, thereby drying the ink droplets ejected onto the surface.

The paper 2 on the surface of which an image has been formed by the print unit 8 is transferred to the pressure drum 26*c* of the fixing unit 10 via the transfer drum 24*c*.

The paper 2 which has been transferred to the pressure drum 26*c* of the fixing unit 10 is conveyed by rotation by the pressure drum 26*c*, whereby the paper is passed below the image reading unit 44 and the image formed on the surface of the paper is read in according to requirements during this passage. Thereupon, the paper 2 is heated and pressurized by the heating rollers 48*a* and 48*b*, whereby the image formed on the surface is fixed.

The paper 2 on which the image has been fixed by the fixing unit 10 is transferred to the conveyor 50 of the paper discharge unit 12, conveyed by the conveyor 50 to the paper discharge magazine 52, and recovered in the paper discharge magazine 52.

First Embodiment of Inkjet Head

Next, an inkjet head relating to a first embodiment of the present invention will be described.

The inkjet heads 40C, 40M, 40Y, 40K, 40R, 40G, 40B each have the same composition and therefore an inkjet head is indicated below by the reference numeral 40 as a representative example of these heads.

Figure 3:
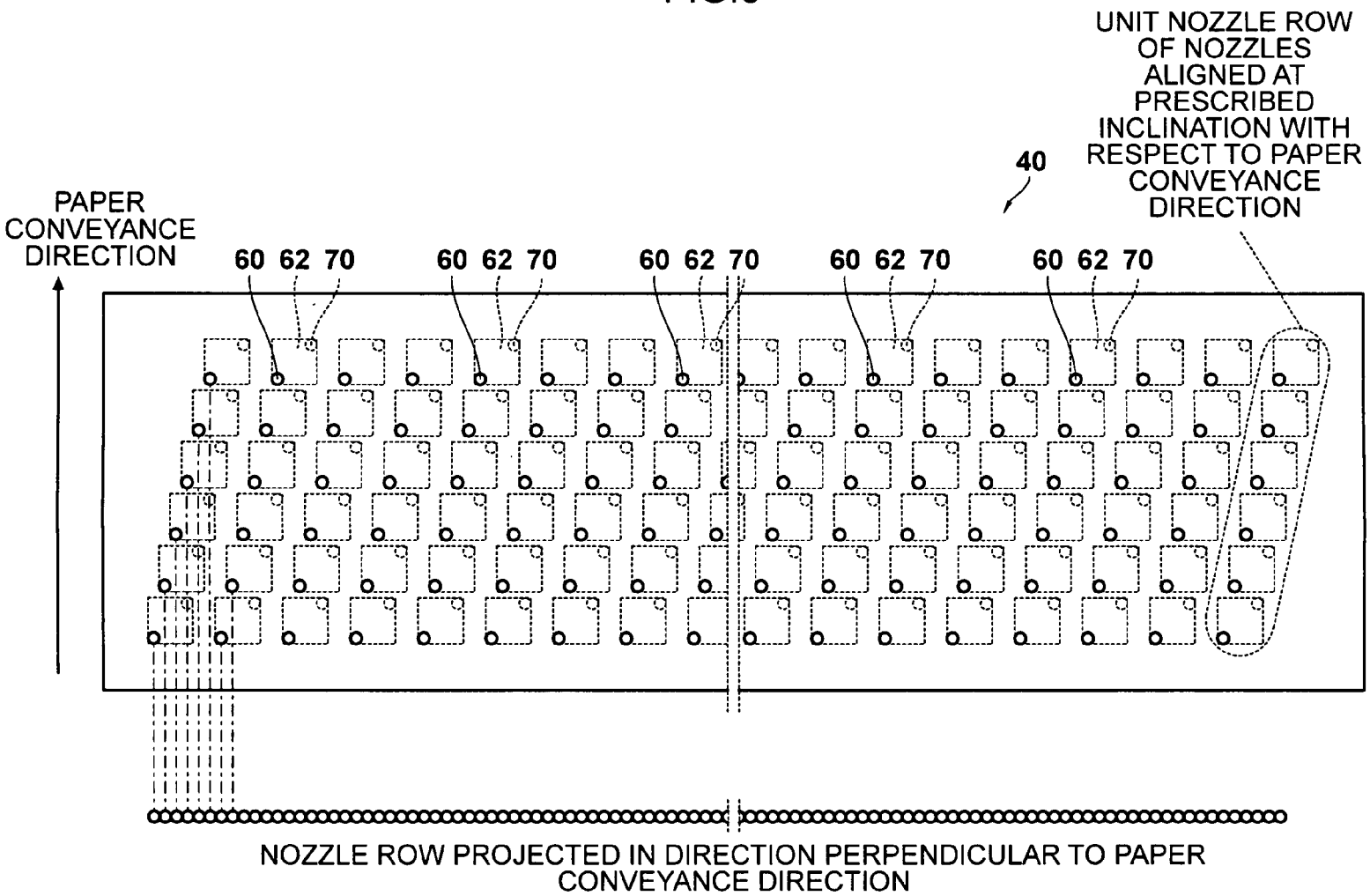
FIG. 3 is a plan view perspective diagram of the ink ejection surface of an inkjet head.

FIG. 3 is a plan view perspective diagram of the ink ejection surface of an inkjet head 40 according to the present embodiment.

As illustrated in FIG. 3, the inkjet head 40 according to the present embodiment has nozzles 60 arranged in a staggered configuration in the ink ejection surface. By adopting an arrangement of this kind, it is possible to reduce the effective nozzle pitch as projected to the lengthwise direction of the head (a direction perpendicular to the conveyance direction of the paper), and a high-density configuration of the nozzles 60 can be achieved.

The ink ejection surface in which the nozzles 60 are arranged is treated with a hydrophobic treatment and thus becomes a hydrophobic surface.

On the other hand, the nozzles 60 are treated with a hydrophilic treatment on the inner circumferential surface thereof, and thus form hydrophilic surfaces.

The nozzles 60 are respectively connected to separately provided pressure chambers 62, via nozzle flow channels (not illustrated).

Figure 4:
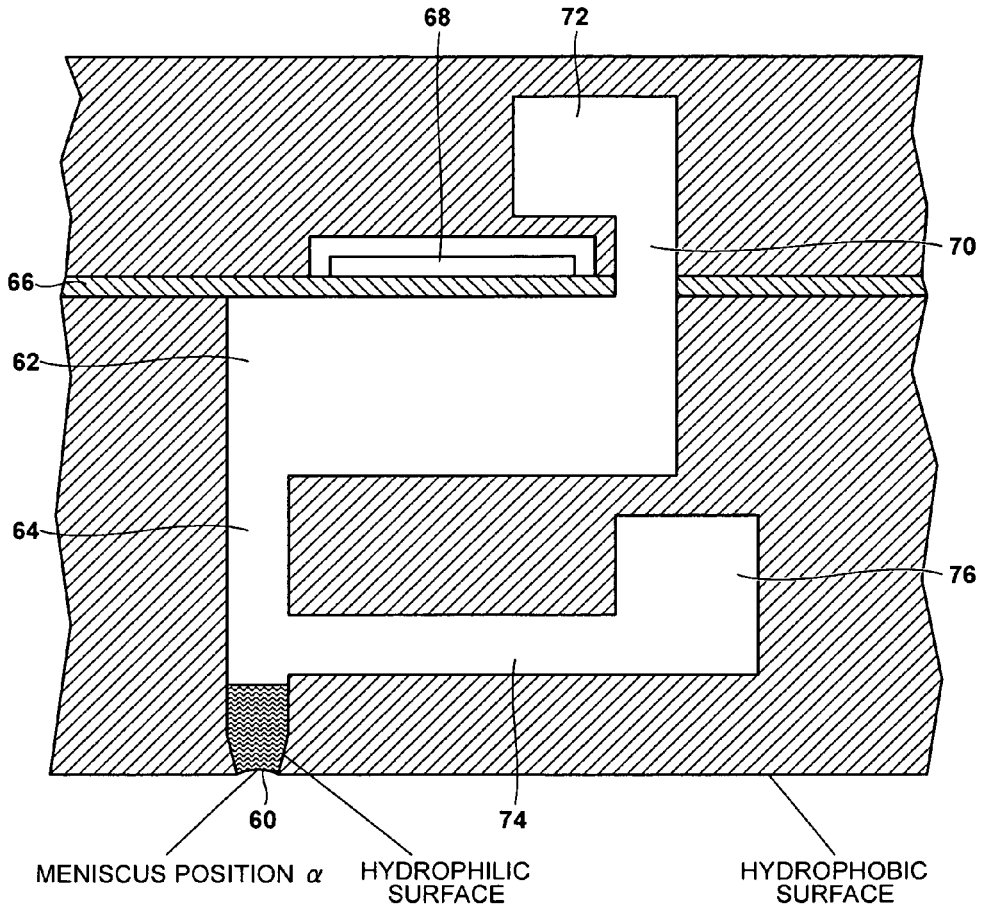
FIG. 4 is a vertical cross-sectional diagram illustrating the internal structure of an inkjet head according to a first embodiment.

FIG. 4 is a cross-sectional diagram illustrating an internal structure of an inkjet head according to the present embodiment. As illustrated in FIG. 4, each of the pressure chambers 62 is formed as a parallelepiped-shaped space, and a nozzle flow channel 64 is formed in one corner of the bottom surface thereof. The nozzle flow channel 64 extends vertically downwards from the pressure chamber 62 and is connected to a nozzle 60.

The ceiling surface of the pressure chamber 62 is constituted by a diaphragm 66 which is formed to be deformable in the upward/downward direction. A piezoelectric element (piezo element) 68 is attached to the top of the diaphragm 66, and the diaphragm 66 deforms in the upward/downward direction due to the piezoelectric element 68. When the diaphragm 66 deforms upward/downward direction, the volume of the pressure chamber 62 expands (increases) or contracts (reduces) and ink is suctioned or ejected from the nozzle 60. In other words, if the diaphragm 66 is deformed in the downward direction, then the volume of the pressure chamber 62 contracts and as a result of this ink is ejected from the nozzle 60. On the other hand, if the diaphragm 66 is deformed in the upward direction, then the volume of the pressure chamber 62 expands and as a result, ink is suctioned from the nozzle 60 (the ink inside the nozzle flow channel 64 is pulled back into the pressure chamber 62).

The piezoelectric element 68 is driven by applying a prescribed drive voltage between an individual electrode (not illustrated) which is provided on top of the piezoelectric element and the diaphragm 66 which acts as a common electrode, and by this means, the diaphragm 66 is deformed in the upward or downward directions.

An individual supply flow channel 70 for supplying ink to the pressure chamber 62 is connected to one corner of the ceiling face of the pressure chamber 62 (in a corner position opposite to the nozzle flow channel 64). This individual supply flow channel 70 is connected to a common supply flow channel 72 for supplying ink to each of the respective individual supply flow channels 70.

A common supply flow channel 72 is provided for each unit row of nozzles 60 aligned at a prescribed inclination with respect to the conveyance direction of the paper 2 (see FIG. 3). Ink is supplied from this common supply flow channel 72, via the individual supply flow channels 70, to the pressure chambers 62 of the nozzles 60 belonging to the respective rows.

The common supply flow channels 72 of respective rows are connected to an ink supply flow channel (not illustrated), and the ink supply flow channel is connected to an ink supply port (not illustrated). Ink from the ink tank is supplied to this ink supply port. The ink which has been supplied to this ink supply port is supplied to the common supply flow channels 72 of the respective rows via the ink supply flow channel, and is further supplied to the respective pressure chambers 62 via the individual supply flow channels 70.

The composition for supplying ink from the ink tank is described in detail below.

An individual recovery flow channel 74 is connected to an intermediate position of each nozzle flow channel 64. The individual recovery flow channel 74 is connected to the nozzle flow channel 64 at a position in the vicinity of the nozzle 60, and extends in the horizontal direction, the end thereof being connected to a common recovery flow channel 76.

Similarly to the common supply flow channel 72, the common recovery flow channel 76 is provided for each unit row of nozzles 60 which are aligned at a prescribed inclination with respect to the direction of conveyance of the paper 2. The common recovery flow channels 76 of the respective rows are connected to an ink recovery flow channel (not illustrated) and the ink recovery flow channel is connected to an ink recovery port (not illustrated).

A portion of the ink which flows through the nozzle flow channels 64 flows into the individual recovery flow channels 74 and is recovered in the common recovery flow channels 76. This ink is then recovered from the common recovery flow channels 76, via the ink recovery flow channel and the ink recovery port, into the ink tank. In other words, in the inkjet head according to the present embodiment, ink is supplied by circulation.

Ink Circulating Supply System

System Composition

Figure 5:
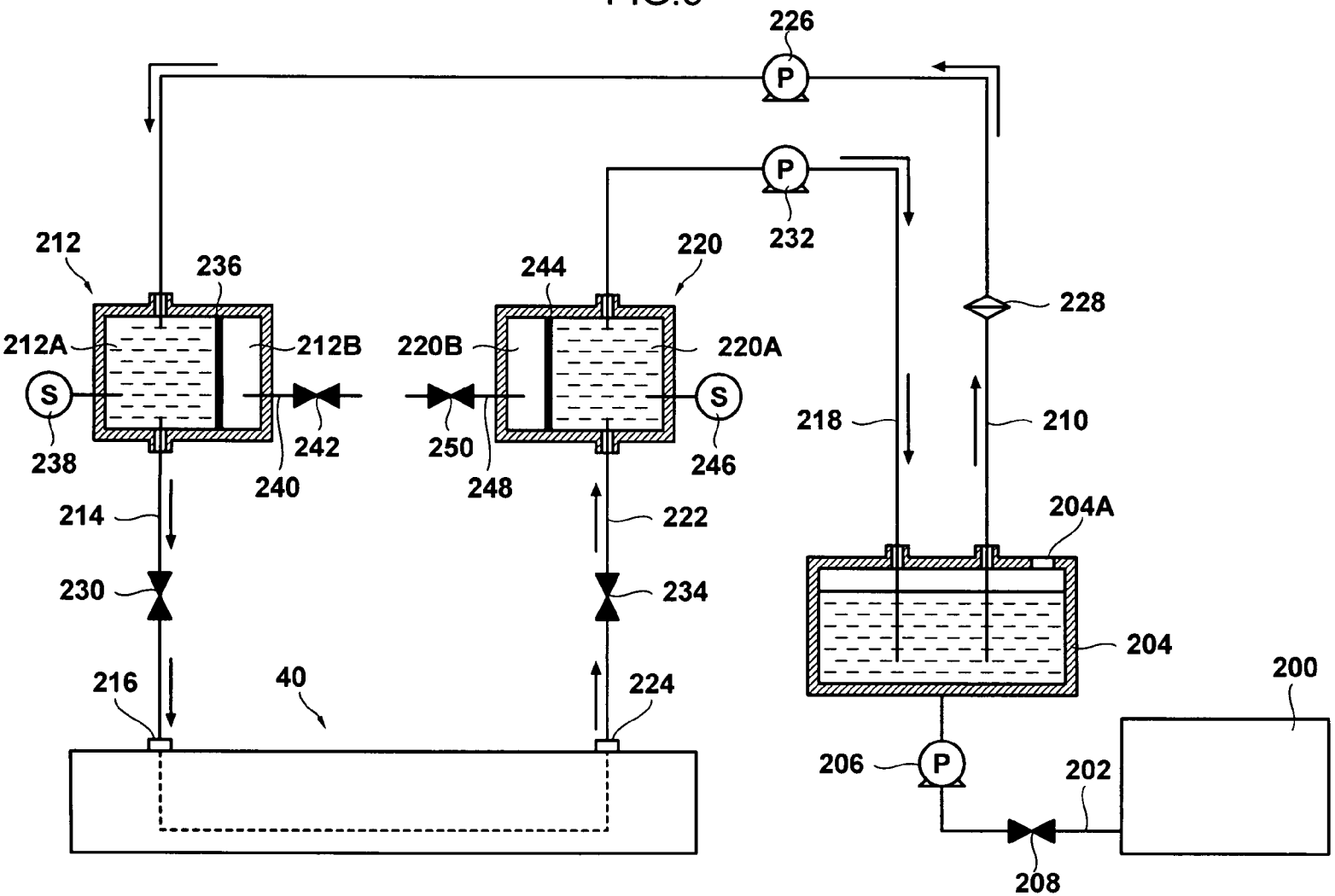
FIG. 5 is an approximate schematic drawing of an ink circulating supply system.

FIG. 5 is a general schematic drawing of a circulating supply system for ink supplied to an inkjet head.

An ink tank 200 is connected to a buffer tank 204 via a tube 202. A main pump 206 and a main valve 208 are provided in this tube 202.

The main pump 206 operates in accordance with instructions from the system controller 100 (see FIG. 2), and sends the ink stored in the ink tank 200 to the buffer tank 204.

The main valve 208 is operated in accordance with instructions from the system controller 100 and opens and closes the tube 202.

The interior of the buffer tank 204 is open to the air via an air opening hole 204A which is formed in the ceiling thereof. A prescribed amount of ink is stored inside the buffer tank 204 by means of the ink supplied from the ink tank 200.

The buffer tank 204 is connected to a supply tank 212 via a first supply flow channel 210, and the supply tank 212 is connected to an ink supply port 216 of the inkjet head 40 via a second supply flow channel 214.

Furthermore, the buffer tank 204 is connected to the recovery tank 220 via a first recovery flow channel 218, and the recovery tank 220 is connected to an ink recovery port 224 of the inkjet head 40 via a second recovery channel 222.

A supply pump 226 and a filter 228 are provided in the first supply flow channel 210. The supply pump 226 operates in accordance with an instruction from the system controller 100, and sends ink from the buffer tank 204 to the supply tank 212. A filter 228 is provided between the supply pump 226 and the buffer tank 204, and removes impurities from the ink supplied to the supply tank 212.

A supply valve 230 is provided in the second supply flow channel 214. The supply valve 230 operates in accordance with an instruction from the system controller 100 and opens and closes the second supply flow channel 214.

A recovery pump 232 is provided in the first recovery flow channel 218. The recovery pump 232 operates in accordance with an instruction from the system controller 100 and sends ink from the recovery tank 220 to the buffer tank 204.

A recovery valve 234 is provided in the second recovery flow channel 222. The recovery valve 234 operates in accordance with an instruction from the system controller 100 and opens and closes the second recovery flow channel 222.

The interior of the supply tank 212 is divided into a supply liquid tank 212A and a supply gas tank 212B by means of an elastic film (a film member made of an elastically deformable material (for example, rubber or a thermoplastic elastomer, or the like, a fluorine rubber or NBR being particularly desirable)) 236.

The first supply flow channel 210 and the second supply flow channel 214 are connected to the supply liquid chamber 212A. Ink supplied from the buffer tank 204 via the first supply flow channel 210 is provisionally stored in this supply liquid chamber 212A. This ink is then supplied from the supply liquid chamber 212A to the inkjet head 40 via the second supply flow channel 214. The internal pressure of the supply liquid chamber 212A is determined by a supply pressure detector 238, and the determination result is output to the system controller 100.

On the other hand, gas is filled into the supply gas chamber 212B. An air opening tube 240 for opening the supply gas chamber 212B to the air is connected to the supply gas chamber 212B. An air opening valve 242 is provided in the air opening tube 240, and the air opening valve 242 opens and closes the air opening tube 240 under the control of the system controller 100.

The interior of the recovery tank 220 is also similarly divided into a recovery liquid chamber 220A and a recovery liquid chamber 220B, by means of an elastic film 244.

The first recovery flow channel 218 and the second recovery flow channel 222 are connected to the recovery liquid chamber 220A. Ink recovered from the inkjet head 40 via the second recovery flow channel 222 is stored provisionally in this recovery liquid chamber 220A. The ink is then recovered from the recovery liquid chamber 220A into the buffer tank 204 via the first recovery flow channel 218. The internal pressure of the recovery liquid chamber 220A is determined by a recovery pressure detector 246, and the determination result is output to the system controller 100.

On the other hand, gas is filled into the recovery gas chamber 220B. An air opening tube 248 for opening the recovery gas chamber 220B to the air is connected to the recovery gas chamber 220B. An air opening valve 250 is provided in the air opening tube 248, and the air opening valve 250 opens and closes the air opening tube 248 under the control of the system controller 100.

Ink Circulating Operation

Next, the operation of circulating ink in the ink circulating supply system composed as described above will be explained.

During circulating supply, the air opening valve 242 which opens the supply gas chamber 212B of the supply tank 212 to the air, and the air opening valve 250 which opens the recovery gas chamber 220B of the recovery tank 220 to the air are respectively closed.

On the other hand, the supply valve 230 of the second supply flow channel 214 which supplies ink from the supply liquid chamber 212A of the supply tank 212 to the inkjet head 40 and the recovery valve 234 of the second recovery flow channel 222 which recovers ink from the inkjet head 40 into the recovery liquid chamber 220A of the recovery tank 220 are respectively opened.

In the ink circulating supply system according to the present embodiment, by setting the pressure on the supply side to be a prescribed amount higher than the pressure on the recovery side, ink is fed to the recovery tank 220 side from the supply tank 212 side, via the inkjet head 40.

More specifically, if the internal pressure of the supply liquid chamber 212A is taken to be $P_{in}$, if the internal pressure of the recovery liquid chamber 220A is taken to be $P_{out}$, if the internal pressure of the back pressure (negative pressure) of the nozzles is taken to be $P_{nzl}$, if the pressure differential (liquid head pressure) occurring due to the height differential between the ink ejection surface and the supply pressure detector 238 is taken to be $H_{in}$, and if the pressure difference (liquid head pressure) occurring due to the height differential between the ink ejection surface and the recovery pressure detector 246 is taken to be $H_{out}$, then a prescribed back pressure is applied to the nozzles by setting: $P_{in}+H_{in}>P_{nzl}>P_{out}+H_{out}$ ($mmH_2O$).

The system controller 100 controls the driving of the supply pump 226 and the recovery pump 232 on the basis of the internal pressure of the supply liquid chamber 212A determined by the supply pressure detector 238 and the internal pressure of the recovery liquid chamber 220A determined by the recovery pressure detector 246, and thereby controls the internal pressure of the supply liquid chamber 212A and the internal pressure of the recovery liquid chamber 220A respectively to the prescribed pressures $P_{in}$ and $P_{out}$. By this means, the ink is circulated and supplied to the inkjet head 40.

In this, even if a pressure variation has occurred due to the operation of the supply pump 226 and the recovery pump 232, this can be absorbed by the supply elastic film 236 provided in the supply tank 212 and the elastic film 244 provided in the recovery tank 220, and therefore pressure variation in the nozzles 60 can be suppressed. By this means, it is possible to keep the back pressure in the nozzles 60 uniform at all times, and high-quality images can be recorded.

This circulating supply operation of the ink is carried out continuously during the operation of the inkjet recording apparatus 1. By circulating the ink continuously during the operation of the apparatus in this way, it is possible to suppress increase in the viscosity of the ink ejected from the nozzles 60.

However, even if the ink is circulated in this way, as illustrated in FIG. 4, the circulation of ink is insufficient in the portion forward of the connecting portion with the individual recovery flow channel 74 (the portion indicated by the wavy lines in FIG. 4), and hence there is a possibility that a sufficient effect in suppressing increase in viscosity cannot be obtained.

Figure 6A:
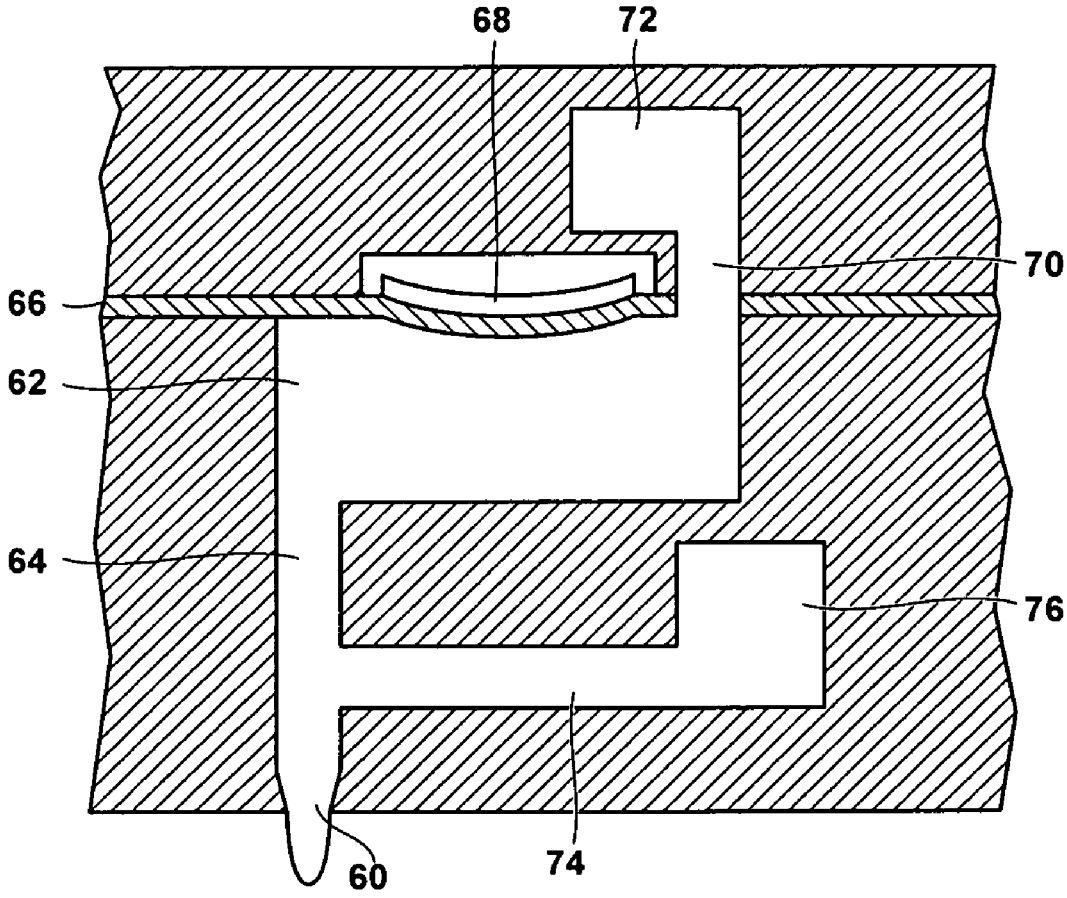
FIGS. 6A and 6B are illustrative diagrams of the action of the inkjet head according to the first embodiment.
Figure 6B:
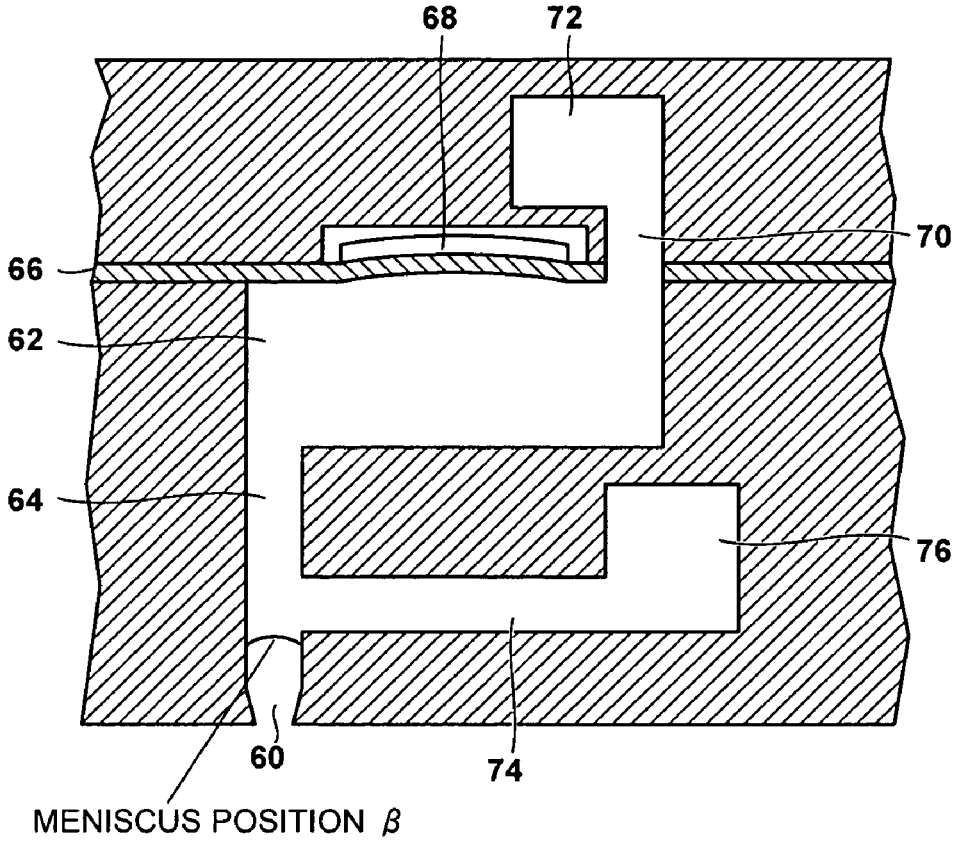

Therefore, in the inkjet head 40 according to the present embodiment, by controlling the position of the ink meniscus, the effect of suppressing increase in the viscosity of the ink during circulating supply of the ink is further enhanced. More specifically, as illustrated in FIGS. 6A and 6B, when ejection is not being performed, the position of the ink meniscus is withdrawn to the vicinity of the connecting portion with the individual recovery flow channel 74. By this means, even when ejection is not being performed, it is possible to circulate the ink sufficiently and therefore increase in the viscosity of the ink can be prevented effectively.

Control of Meniscus Position

Below, the method of controlling ejection of the ink, including control of the meniscus position, will be described.

As stated above, in the inkjet head 40 according to the present embodiment, when not performing ejection, the position of the ink meniscus is withdrawn to the vicinity of the connecting portion with the individual recovery flow channel 74. This processing is carried out by expanding the volume of the pressure chamber 62. In other words, when the volume of the pressure chamber 62 is expanded, the ink inside the nozzle flow channel 64 is drawn inside the pressure chamber 62, and consequently, the position of the ink meniscus is withdrawn inside the nozzle flow channel 64.

When not ejecting, the system controller 100 applies a prescribed drive voltage to a piezoelectric element 68, thereby causing the ceiling face of the pressure chamber 62 to be displaced upwards by a prescribed amount, and causing the volume of the pressure chamber 62 to expand by a prescribed amount. By this means, as illustrated in FIG. 6B, a prescribed amount of the ink inside the nozzle flow channel 64 is drawn inside the pressure chamber 62, and the position of the ink meniscus is withdrawn to the vicinity of the connecting portion with the individual recovery flow channel 74.

During ejection, the system controller 100 applies a prescribed drive voltage to the piezoelectric element 68 and causes the ceiling face of the pressure chamber 62 to be displaced downwards. By this means, as illustrated in FIG. 6A, the volume of the pressure chamber 62 is contracted and a prescribed ejection volume of ink is ejected from the nozzle 60.

Figure 7A:
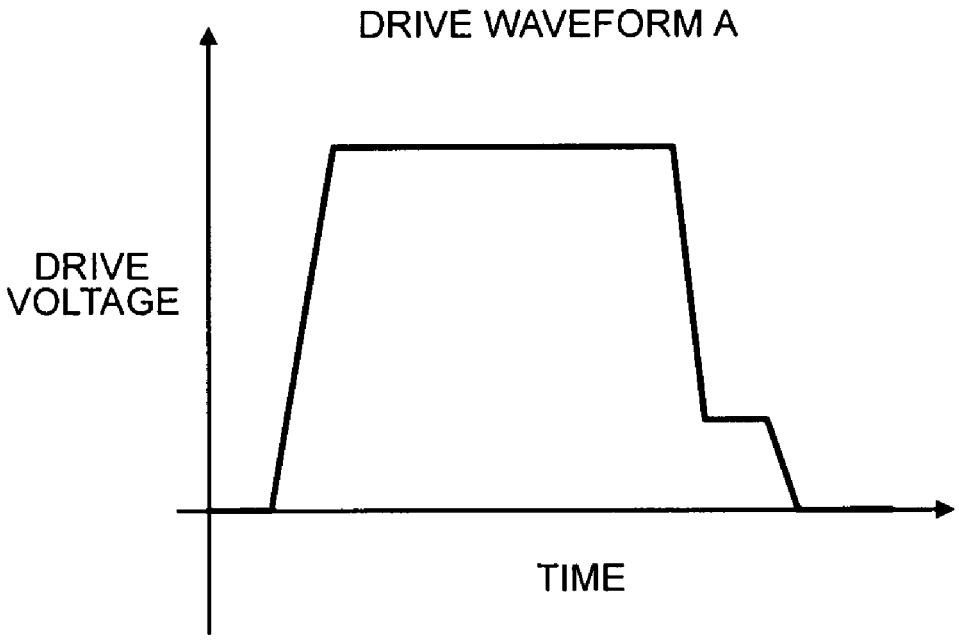
FIGS. 7A and 7B are diagrams illustrating one example of a voltage drive waveform which is applied to a piezoelectric element, when ejecting ink and when not ejecting ink.
Figure 7B:
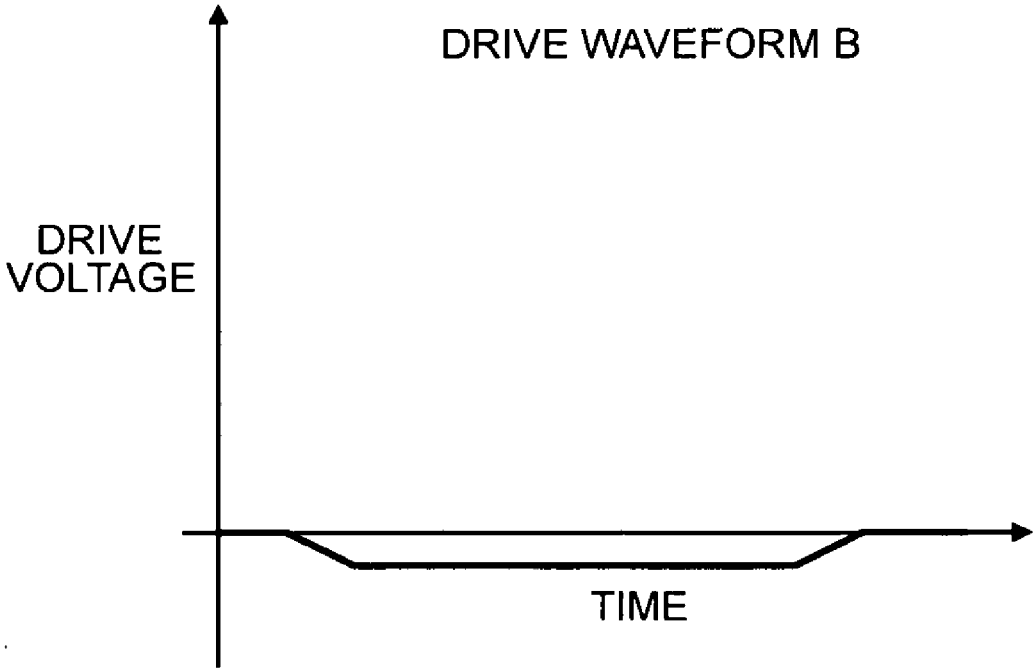

FIGS. 7A and 7B are diagrams illustrating one example of a voltage drive waveform which is applied to a piezoelectric element, when ejecting ink and when not ejecting ink, respectively.

As illustrated in FIG. 7A, when ejecting ink, the piezoelectric element 68 is driven by the drive waveform A, and the ceiling face of the pressure chamber 62 is displaced downwards by a prescribed amount. More specifically, the piezoelectric element 68 is driven to an amount of displacement required in order to eject the prescribed ejection volume.

In the present embodiment, in order to suppress vibration of the ink, the voltage is applied in a stepped fashion at the end of the voltage application. More specifically, rather than reducing the drive voltage immediately to zero, the voltage is first reduced to a prescribed voltage, and then reduced to zero. By this means, it is possible to suppress vibration upon return of the meniscus, and therefore the meniscus position can be controlled with greater accuracy.

On the other hand, when not ejecting ink, as illustrated in FIG. 7B, the piezoelectric element 68 is driven by the drive waveform B, and the ceiling face of the pressure chamber 62 is displaced upwards by a prescribed amount. In other words, the piezoelectric element 68 is driven to an amount of displacement necessary in order to withdraw the ink meniscus position to the vicinity of the connecting portion with the individual recovery flow channel 74.

Information about the drive waveform of the piezoelectric element 68 when ejecting and when not ejecting is stored in the ROM. The system controller 100 judges whether or not ejection is to be performed and selects the drive waveform of the voltage to be applied to the piezoelectric element 68.

Figure 8:
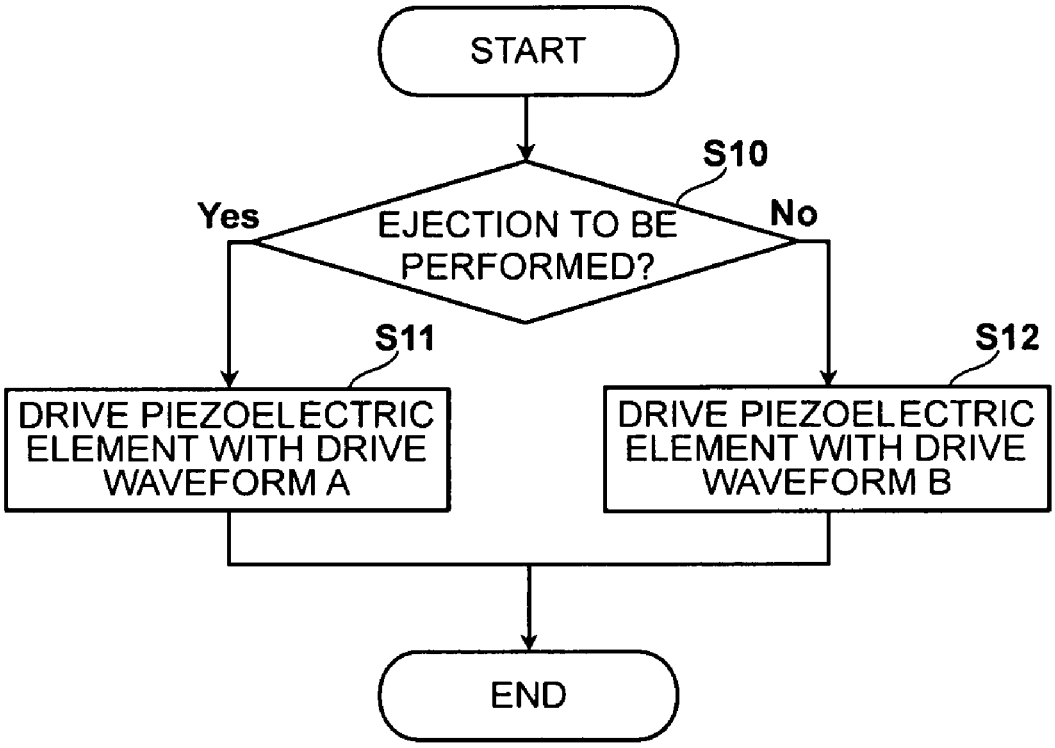
FIG. 8 is a flowchart showing steps of ink ejection control in one cycle in the inkjet head according to the first embodiment.

FIG. 8 is a flowchart showing a procedure for controlling ink ejection in one cycle, including control of the meniscus position, in an inkjet head according to the present embodiment.

As illustrated in FIG. 8, the system controller 100 judges whether or not ejection is to be performed (step S10), and selects the drive waveform of the voltage to be applied to a piezoelectric element 68.

If ejection is to be performed, then drive waveform A is selected and the piezoelectric element 68 is driven by the selected drive waveform A. By this means, the ceiling surface of the pressure chamber 62 is displaced downwards by a prescribed amount, and the volume of the pressure chamber 62 is contracted by a prescribed amount. Consequently, as illustrated in FIG. 6A, an ink droplet of a prescribed ejection volume is ejected from the nozzle 60. After ejection, the ink meniscus position inside the nozzle 60 is situated in the vicinity of the opening of the nozzle 60 (meniscus position $\alpha$), as illustrated in FIG. 4.

On the other hand, if ejection is not to be performed, then the drive waveform B is selected and the piezoelectric element 68 is driven by the selected drive waveform. Consequently, the ceiling surface of the pressure chamber 62 is displaced upwards by a prescribed amount, and the volume of the pressure chamber 62 is expanded by a prescribed amount. Therefore, the ink in the nozzle flow channel 64 is pulled into the pressure chamber 62, and as illustrated in FIG. 6B, the ink meniscus position is withdrawn up to the vicinity of the connecting portion with the individual recovery flow channel 74 (meniscus position $\beta$) (namely, the ink is withdrawn from the meniscus position $\alpha$ illustrated in FIG. 4 to the meniscus position $\beta$ illustrated in FIG. 6B).

In this way, the ejection of ink is controlled by driving the piezoelectric element 68 by means of the drive waveform A when ejecting and by means of the drive waveform B when not ejecting. By this means, it is possible to withdraw the ink meniscus position to the vicinity of the connecting portion of the individual recovery flow channel 74, when not ejecting. By withdrawing the ink meniscus position to the vicinity of the connecting portion of the individual recovery flow channel 74 when not ejecting in this way, it is possible effectively to prevent increase in the viscosity of the ink in the nozzle portion, in respect of the ink stagnation region of the nozzle flow channel 64 between the nozzle portion and the individual recovery flow channel 74 (the portion indicated by the wavy lines in FIG. 4).

As described above, in the inkjet head 40 according to the present embodiment, the ink meniscus position is controlled during a recording operation and when not ejecting, the ink meniscus position is withdrawn to the vicinity of the connecting portion with the individual recovery flow channel 74. By this means, even when ejection is not being performed, it is possible to circulate the ink sufficiently and therefore increase in the viscosity of the ink can be prevented effectively.

Second Embodiment of Inkjet Head

In the inkjet head according to the first embodiment described above, increase in the viscosity of the ink is prevented by withdrawing the ink meniscus position to the vicinity of the connecting portion with the individual recovery flow channel when not performing ejection.

If a long period of time elapses, the ink meniscus position thus withdrawn returns up to the vicinity of the nozzle opening again due to capillary action (meniscus position $\alpha$ in FIG. 4).

Therefore, in the inkjet head according to the present embodiment, the ink meniscus position thus withdrawn can be maintained.

Figure 9:
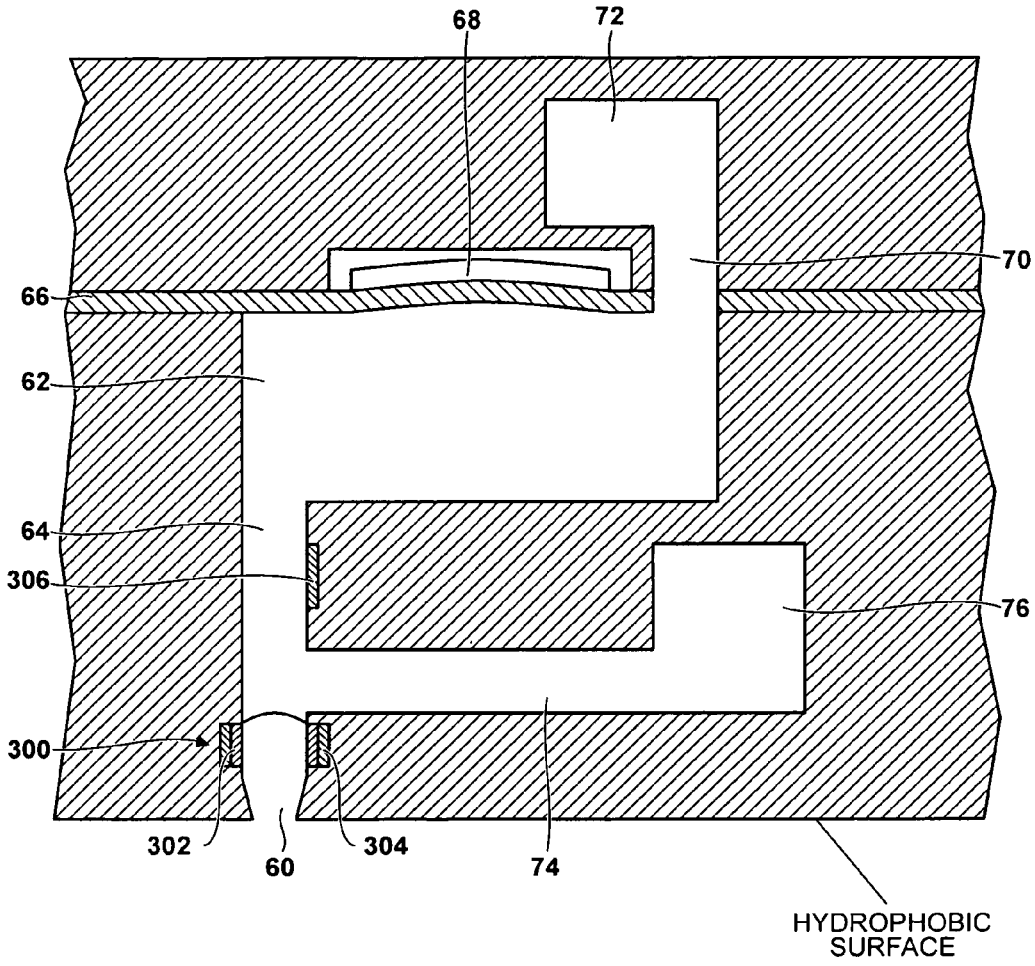
FIG. 9 is a vertical cross-sectional diagram illustrating the internal structure of an inkjet head according to a second embodiment.

FIG. 9 is a vertical cross-sectional diagram illustrating the internal structure according to an inkjet head relating to a second embodiment of the present invention.

As illustrated in FIG. 9, the inkjet head according to the present embodiment has meniscus position holding devices 300 provided in the respective nozzle flow channels, for maintaining the ink meniscus position which has been withdrawn inside each nozzle flow channel when not performing ejection. Apart from the fact that this meniscus position holding device 300 is provided, this head is the same as the inkjet head 40 according to the first embodiment which is described above. Consequently, below, only the composition of the meniscus position holding device 300 is described (the remainder of the composition is labeled with the same reference numerals as the inkjet head 40 according to the first embodiment described above, and further explanation thereof is omitted here.)

As illustrated in FIG. 9, the meniscus position holding device 300 principally comprises a tubular inner surface properties switching member 302 which constitutes a portion of the nozzle flow channel 64, a tubular first electrode 304 which is bonded to the outer circumference of the inner surface properties switching member 302, and a second electrode 306 provided inside the nozzle flow channel 64.

The inner surface properties switching member 302 is constituted by a hydrophobic insulating body (for example, $SiO_2$, SiN, $Ta_2O_5$, or the like), which is filled into the inner wall surface of the nozzle flow channel 64, and forms a portion of the nozzle flow channel 64. In other words, the inner diameter of the inner surface properties switching member 302 is formed to the same size as the inner diameter of the nozzle flow channel 64, the member being disposed coaxially with the nozzle flow channel 64, and the inner circumferential surface thereof is disposed on the same surface as the inner circumferential surface of the nozzle flow channel 64.

This inner surface properties switching member 302 is disposed in a position where the meniscus position is withdrawn when not ejecting (meniscus position β), in other words, in the vicinity of the connecting portion with the individual recovery flow channel 74. In the present embodiment, as illustrated in FIG. 9, the inner surface properties switching member 302 is disposed through a prescribed length (height) in the portion of the nozzle flow channel forward of the meniscus position β to which the meniscus is withdrawn when not ejecting (the nozzle side nozzle flow channel) 64.

The first electrode 304 is bonded to the outer circumferential surface of the inner surface properties switching member 302 which is formed in a tubular shape.

The second electrode 306 is provided inside the nozzle flow channel 64 on the upstream side of the inner surface properties switching member 302 (the pressure chamber 62 side). An electric field is applied to the ink flowing inside the nozzle flow channel 64. In the present embodiment, the inner surface properties switching member 302 is buried in the inner wall surface of the nozzle flow channel 64, in such a manner that the member forms a portion of the inner wall surface.

A prescribed voltage is applied from a power source (not illustrated) between the first electrode 304 and the second electrode 306, under the control of the system controller 100.

The inner surface properties of the inner surface properties switching member 302 in the meniscus position holding device 300 composed as described above are switched between hydrophilic and hydrophobic properties by means of an electrowetting phenomenon, by turning the passage of current between the first electrode 304 and the second electrode 306 on and off. In other words, by applying a prescribed voltage and switching the passage of current on, then the inner surface properties of the inner surface properties switching member 302 are switched to hydrophilic. On the other hand, if the applied voltage is set to zero and the passage of current is switched off, then the inner surface properties of the inner surface properties switching member 302 are switched to hydrophobic. By switching the passage of current off and making the inner surface properties of the inner surface properties switching member 302 hydrophobic, it is possible to maintain the withdrawn ink meniscus position.

Here, a simple description of this electrowetting phenomenon will be given.

Electrowetting is a phenomenon whereby the hydrophobic properties (wetting angle) on the surface of an insulating layer change when a potential difference is produced between the respective sides of the insulating layer.

Figure 10A:
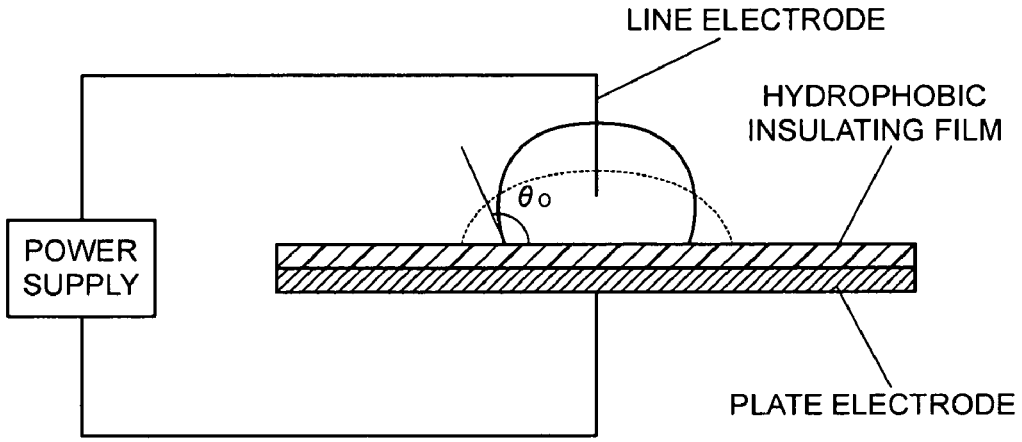
FIGS. 10A and 10B are illustrative diagrams of an electrowetting phenomenon.
Figure 10B:
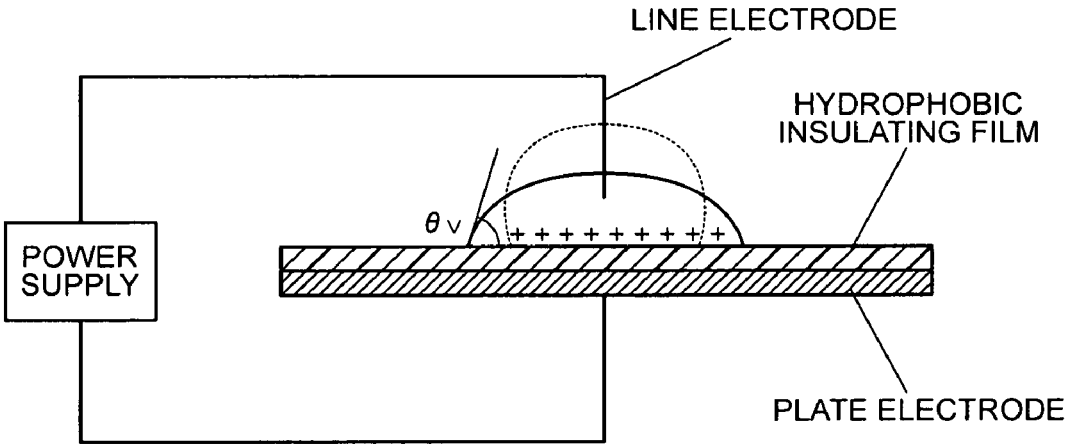

As illustrated in FIGS. 10A and 10B, it is supposed that a hydrophobic insulating film is formed on a plate electrode, and a liquid droplet connected to a line electrode is situated on top of this hydrophobic insulating film.

If a prescribed voltage V is applied between the plate electrode and the line electrode, then the following relationship is established in respect of the angle of contact $\theta_v$ of the droplet: $\cos\theta_v = \cos\theta_0 - C^2 \times V^2/2$.

Here, the $\theta_0$ is the angle of contact of the liquid droplet when the voltage is 0; C is the static capacitance of the hydrophobic insulating film; and V is the applied voltage. In this way, when the voltage is 0 (i.e. the current is not applied (off)), the angle of contact $\theta_0$ of the droplet on the hydrophobic insulating film is $\theta_0 > 90°$ (FIG. 10A), whereas when a prescribed voltage V is applied between the plate electrode and the line electrode (i.e. the current is applied (on)), then the angle of contact $\theta_v$ of the droplet can be made to become $\theta_v < 90°$ (FIG. 10B), and hence the function of a hydrophilic film can be obtained.

Consequently, it is possible to obtain a desired contact angle by adjusting the ink material, the material of the hydrophobic insulating film, the film thickness, and the applied voltage.

In this way, the meniscus position holding device 300 uses an electrowetting phenomenon to switch the inner surface properties of the inner surface properties switching member 302, and thereby stably holds the ink meniscus position which has been withdrawn inside the nozzle flow channel 64.

Control of Meniscus Position

Next, the method of controlling the ejection of ink by the inkjet head according to the present embodiment, including meniscus position control, will be described.

Similarly to the inkjet head according to the first embodiment which is described above, in the inkjet head according to the present embodiment, the ink meniscus position is withdrawn to the vicinity of the connecting portion with the individual recovery flow channel 74 when not performing ejection. Similarly to the inkjet head according to the first embodiment described above, this process is carried out by expanding the volume of the pressure chamber 62. In other words, by driving the piezoelectric element 68 with a prescribed drive waveform B and displacing the ceiling face of the pressure chamber 62 upwards by a prescribed amount, the volume of the pressure chamber 62 is expanded by a prescribed amount, whereby the ink inside the nozzle flow channel 64 is pulled back inside the pressure chamber 62 and the ink meniscus position is withdrawn to the vicinity of the connecting portion of the individual recovery flow channel 74.

In the inkjet head according to the present embodiment, after the ink meniscus position has been withdrawn to the vicinity of the connecting portion with the individual recovery flow channel 74, the inner surface properties of the inner surface properties switching member 302 are switched to hydrophilic, whereby the withdrawn ink meniscus position is held in position. More specifically, ink is drawn up when the inner surface properties of the inner surface properties switching member 302 are switched to hydrophilic, and when the meniscus position has been withdrawn to a prescribed position, the inner surface properties of the inner surface properties switching member 302 are switched to hydrophobic.

When performing ejection, the inner surface properties of the inner surface properties switching member 302 are switched to hydrophilic, the piezoelectric element 68 is driven in this state by the prescribed drive waveform A (see FIG. 10A) and an ink droplet of a prescribed ejection volume is ejected from the nozzle 60.

Figure 11:
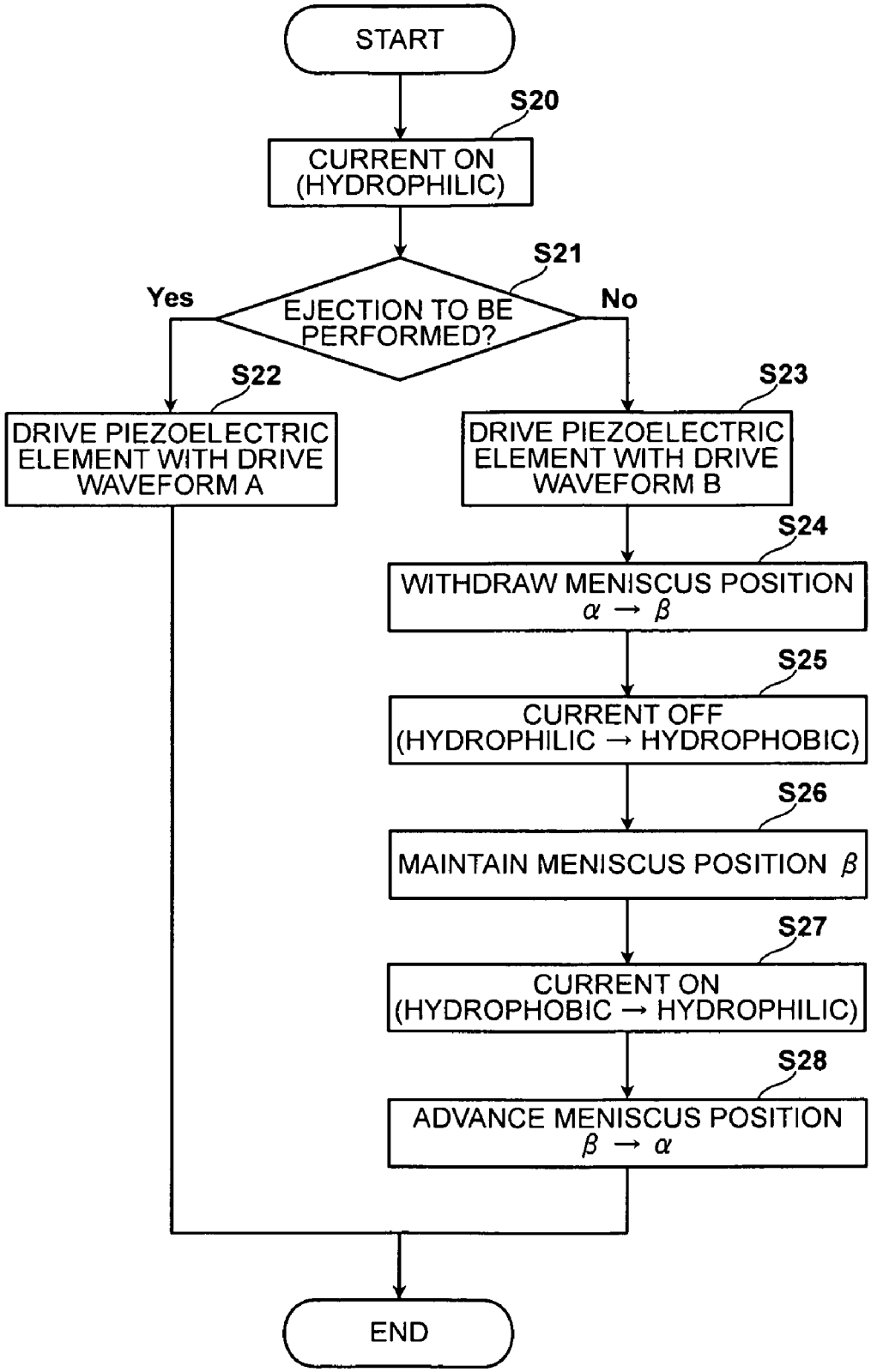
FIG. 11 is a flowchart showing steps of ink ejection control in one cycle in the inkjet head according to the second embodiment.

FIG. 11 is a flowchart showing steps for controlling ink ejection in one cycle, including control of the meniscus position, in an inkjet head according to the present embodiment.

Firstly, the system controller 100 applies a prescribed voltage between the first electrode 304 and the second electrode 306, and the passage of current between the first electrode 304 and the second electrode 306 is switched on (step S20). By this means, the inner surface properties of the inner surface properties switching member 302 are set to hydrophilic.

Next, the system controller 100 judges whether or not ejection is to be performed (step S21).

If, as a result of this, it is judged that ejection is to be performed, then the system controller 100 selects the drive waveform A and drives the piezoelectric element 68 with the selected drive waveform A (step S22). By this means, the ceiling surface of the pressure chamber 62 is displaced downwards by a prescribed amount, and the volume of the pressure chamber 62 is contracted by a prescribed amount. Consequently, an ink droplet of a prescribed ejection volume is ejected from the nozzle 60 (see FIG. 6A).

After ejection, the ink meniscus position inside the nozzle 60 is situated in the vicinity of the opening of the nozzle 60 (meniscus position α) (see FIG. 4).

On the other hand, if it is judged that ejection is not to be performed, then the system controller 100 selects the drive waveform B and drives the piezoelectric element 68 with the selected drive waveform B (step S23). Consequently, the ceiling surface of the pressure chamber 62 is displaced upwards by a prescribed amount, and the volume of the pressure chamber 62 is expanded by a prescribed amount. As a result, the ink inside the nozzle flow channel 64 is drawn inside the pressure chamber 62, and the ink meniscus position is withdrawn to the vicinity of the connecting portion with the individual recovery flow channel 74 (meniscus position β) (see FIG. 9). In other words, the ink meniscus is withdrawn from the meniscus position α in the vicinity of the opening of the nozzle 60 to the meniscus position β in the vicinity of the connecting portion with the individual recovery flow channel 74 (step S24). In this case, the ink is pulled inside the pressure chamber 62 in a state where the inner surface properties of the inner surface properties switching member 302 are hydrophilic.

The system controller 100 then sets the voltage applied between the first electrode 304 and the second electrode 306 to zero, and the passage of current between the first electrode 304 and the second electrode 306 is switched off (step S25). By this means, the inner surface properties of the inner surface properties switching member 302 are switched to hydrophobic. By switching the inner surface properties of the inner surface properties switching member 302 to hydrophobic in this way, the ink meniscus position which has been withdrawn to the meniscus position β in the vicinity of the connecting portion of the individual recovery flow channel 74 is held stably at the meniscus position β in the vicinity of the connecting portion of the individual recovery flow channel 74 (step S26).

In accordance with the end of a non-ejecting step, the system controller 100 applies a prescribed voltage between the first electrode 304 and the second electrode 306, and the passage of current between the first electrode 304 and the second electrode 306 is switched on (step S27). By this means, the inner surface properties of the inner surface properties switching member 302 are switched to hydrophilic. By switching the inner surface properties of the inner surface properties switching member 302 to hydrophilic, the meniscus position holding function performed by the inner surface properties switching member 302 is lost, the voltage of the drive waveform B becomes zero, and the meniscus position advances (descends) to the vicinity of the original nozzle opening portion (meniscus position α) (step S28).

In this way, in the inkjet head according to the present embodiment, the ink meniscus position is withdrawn to the vicinity of the connecting portion with the individual recovery flow channel 74 when not performing ejection, and the meniscus position thus withdrawn is held by the meniscus position holding device 300. By this means, it is possible to hold the withdrawn meniscus position stably, and increase in the viscosity of the ink can be prevented more effectively.

By providing the meniscus position holding device 300 as in the inkjet head according to the present embodiment, it is possible to hold the withdrawn meniscus position stably over a long period of time.

Therefore, in the inkjet head according to the present embodiment, it is desirable to withdraw the ink meniscus position to the vicinity of the connecting portion with the individual recovery flow channel 74 at all times, even when not performing a recording operation (to maintain the meniscus at the meniscus position β). More specifically, when not performing a recording operation, the piezoelectric element 68 is driven by the drive waveform B, the ink meniscus position is thereby withdrawn to the vicinity of the connecting portion of the individual recovery flow channel 74 (the meniscus position β), and this withdrawn state is maintained by the meniscus position holding device 300 (the passage of current between the first electrode 304 and the second electrode 306 is switched off, and the meniscus position is maintained in the vicinity of the connecting portion of the individual recovery flow channel 74 (meniscus position β)). Accordingly, it is possible to prevent increase in the viscosity of the ink in the nozzles more effectively.

Furthermore, in the example described above, the meniscus position is returned to the original position (meniscus position α), in each cycle, but if a non-ejecting state continues, then it is possible to maintain the withdrawn state. In other words, in the example described above, the meniscus position which is withdrawn when not ejecting is returned to the original meniscus position α simultaneously with the end of one cycle, but if ejection is not to be performed in the next cycle either, then the withdrawn state may be maintained, without returning the meniscus to the original meniscus position α.

Figure 12:
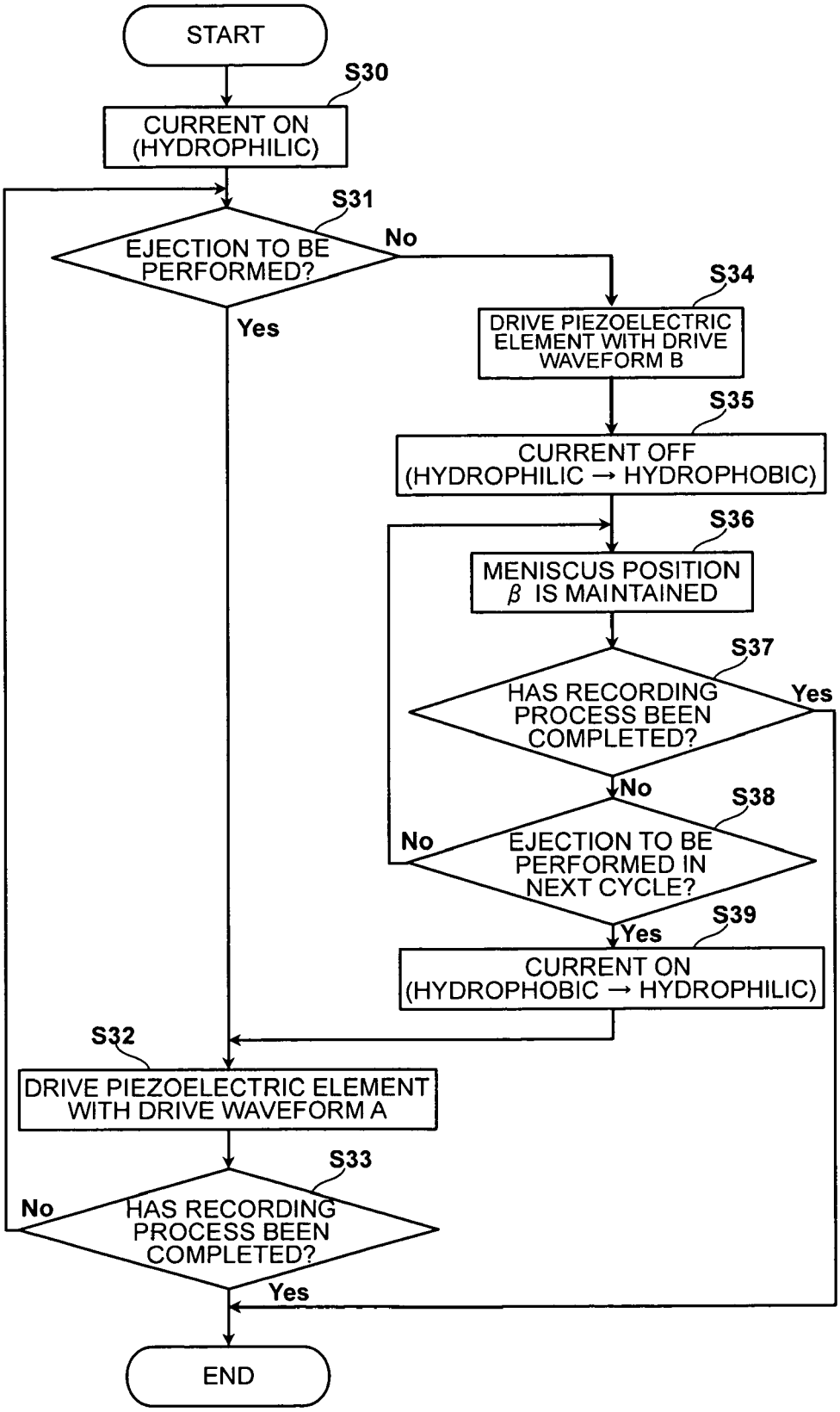
FIG. 12 is a flowchart showing ink ejection control steps in a case where the meniscus position is maintained when a non-ejecting state continues.

FIG. 12 is a flowchart showing ink ejection control steps in a case where the meniscus position is maintained when a non-ejecting state continues.

When the recording process is started, firstly, the system controller 100 applies a prescribed voltage between the first electrode 304 and the second electrode 306, and the passage of current between the first electrode 304 and the second electrode 306 is switched on (step S30). By this means, the inner surface properties of the inner surface properties switching member 302 are set to hydrophilic.

Next, the system controller 100 judges whether or not ejection is to be performed (step S31).

If, as a result of this, it is judged that ejection is to be performed, then the system controller 100 drives the piezoelectric element 68 with the drive waveform A, and an ink droplet of a prescribed ejection volume is ejected from the nozzle 60 (step S32).

Thereupon, the system controller 100 judges whether or not the recording operation has been completed (whether or not this is the final ejecting action for forming the image) (step S33).

Here, if is judged that the recording operation has been completed, then the system controller 100 terminates the ejection control processing.

On the other hand, if it is judged that the recording operation has not been completed, then the system controller 100 returns to step S31 and the presence or absence of ejection in the next cycle is determined.

If it is determined at step S31 that there is to be no ejection, then the system controller 100 drives the piezoelectric element 68 with the drive waveform B, and the meniscus position is withdrawn to the vicinity of the connecting portion with the individual recovery flow channel 74 (the meniscus position β) (step S34). The system controller 100 then sets the voltage applied between the first electrode 304 and the second electrode 306 to zero, and the passage of current between the first electrode 304 and the second electrode 306 is switched off (step S35). By this means, the inner surface properties of the inner surface properties switching member 302 are switched to hydrophobic, and the withdrawn meniscus position is maintained at the withdrawn position (meniscus position β) (step S36).

Thereupon, the system controller 100 judges whether or not the recording process has been completed (step S37).

Here, if it is judged that the recording operation has ended, then the system controller 100 terminates the ejection control processing.

On the other hand, if it is judged that the recording process has not been completed, then the system controller 100 judges whether or not ejection is to be performed in the next cycle (step S38).

Here, if it is judged that ejection is not to be performed in the next cycle, then the system controller 100 maintains the withdrawn state of the meniscus position (step S36).

If, on the other hand, it is judged that ejection is to be performed in the next cycle, then the system controller 100 switches the passage of current between the first electrode 304 and the second electrode 306 on, in accordance with the end of the non-ejection step, and thereby switches the inner surface properties of the inner surface properties switching member 302 to hydrophilic (step S39).

Subsequently, in the next cycle, the system controller 100 drives the piezoelectric element 68 with the drive waveform A, and an ink droplet of a prescribed ejection volume is ejected from the nozzle 60 (step S32). When the ejection process has been completed, the system controller 100 judges whether or not the recording process has been completed (whether or not this is the last ejection action for forming an image) (step S33), and if it is judged that the recording process has been completed, then the ejection control process is terminated. On the other hand, if it is judged that the recording operation has not ended, then the system controller 100 returns to step S31 and the presence or absence of ejection in the next cycle is determined.

If a non-ejecting state continues in this way, then it is possible to maintain the withdrawn state without making the meniscus position return downwards.

Third Embodiment of Inkjet Head

In the inkjet heads of the first and second embodiments described above, when the ink meniscus position is withdrawn, the ink meniscus position is withdrawn by expanding the volume of the pressure chamber 62.

In the inkjet head according to the present embodiment, a special device for withdrawing the ink meniscus position is provided separately.

Figure 13:
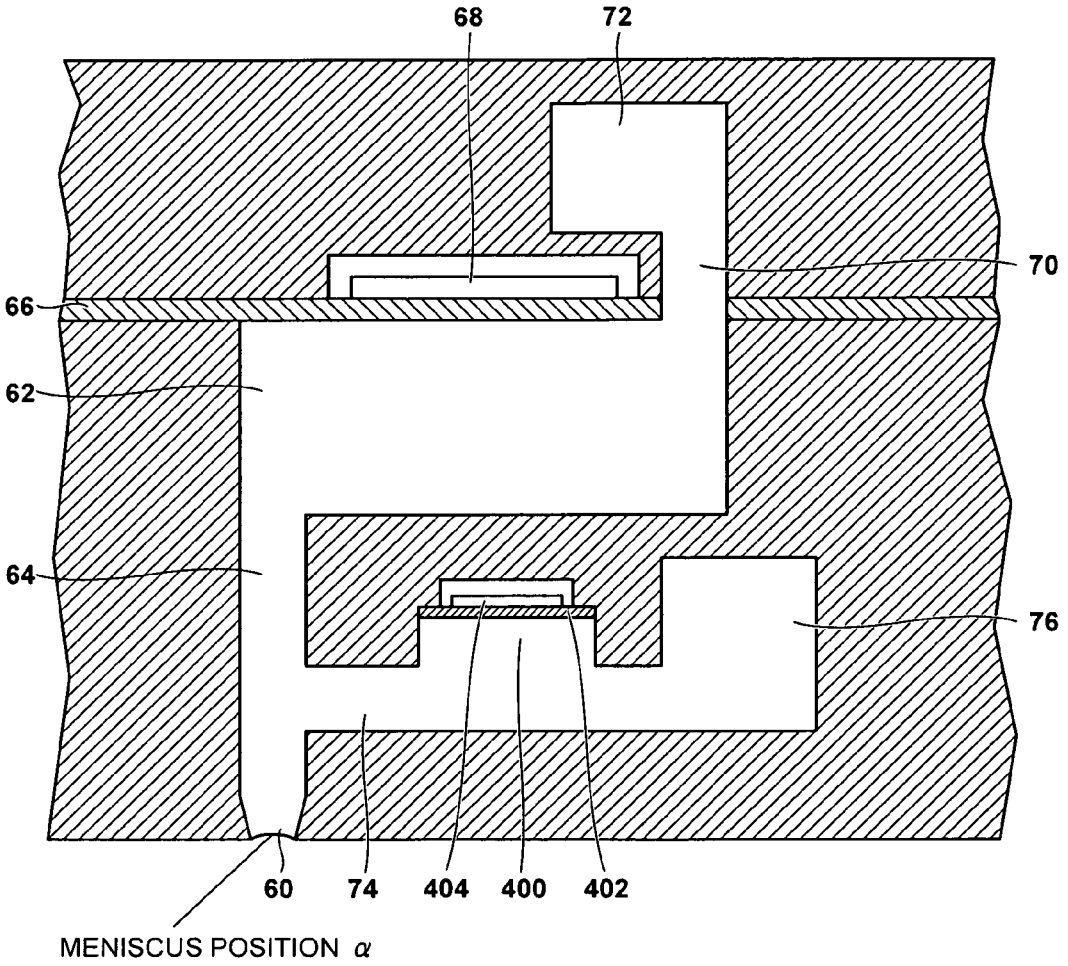
FIG. 13 is a vertical cross-sectional diagram illustrating the internal structure of an inkjet head according to a third embodiment.

FIG. 13 is a vertical cross-sectional diagram illustrating the internal structure according to an inkjet head relating to a third embodiment of the present invention.

As illustrated in FIG. 13, in the inkjet head according to the present embodiment, a suction chamber 400 is provided at an intermediate point of each individual recovery flow channel 74, and by suctioning the ink inside the nozzle flow channel 64 into this suction chamber 400, the meniscus position is withdrawn to the vicinity of the connecting portion with the individual recovery flow channel 74 (meniscus position β).

In this way, in the inkjet head according to the present embodiment, since the ink inside the nozzle flow channels 64 is suctioned by means of the suction chambers 400, then respective pressure chambers 62 only perform ejection operations.

The inkjet head according to the present embodiment is the same as the inkjet head 40 according to the first embodiment which is described above, apart from the fact that suction chambers 400 are provided and the operation of the pressure chambers 62 is different. Consequently, below, only the composition of the suction chambers 400 is described (the remainder of the composition is labeled with the same reference numerals as the inkjet head 40 according to the first embodiment described above, and further explanation thereof is omitted here.)

As illustrated in FIG. 13, each of the suction chambers 400 is formed as a parallelepiped-shaped (rectangular parallelepiped-shaped) space, and the individual recovery flow channel 74 is formed in one portion of the bottom surface thereof.

The ceiling surface of each suction chamber 400 is constituted by a suctioning diaphragm 402 which is composed so as to be deformable in the upward/downward direction. A suctioning piezoelectric element 404 is attached to the top of the suctioning diaphragm 402. The suctioning diaphragm 402 is deformed in the upward/downward direction by this suctioning piezoelectric element 404. When the suctioning diaphragm 402 is deformed in the upward direction, then the volume of the suction chamber 400 expands (increases), and ink in the nozzle flow channel 64 is drawn into the suction chamber 400 via the individual recovery flow channel 74. As a result of this, the ink meniscus position is withdrawn inside the nozzle flow channel 64.

The system controller 100 controls the driving of the suctioning piezoelectric element 404 to adjust the ink meniscus position when not ejecting. More specifically, a voltage having a prescribed drive waveform is applied to the suctioning piezoelectric element 404 when not ejecting, thereby causing the suctioning piezoelectric element 404 to be displaced by a prescribed amount. The drive waveform of the voltage applied to the suctioning piezoelectric element 404 is set to a drive waveform which is necessary and sufficient to withdraw the ink meniscus position to the vicinity of the connecting portion with the individual recovery flow channel 74, by deforming the suctioning piezoelectric element 404.

Figure 14A:
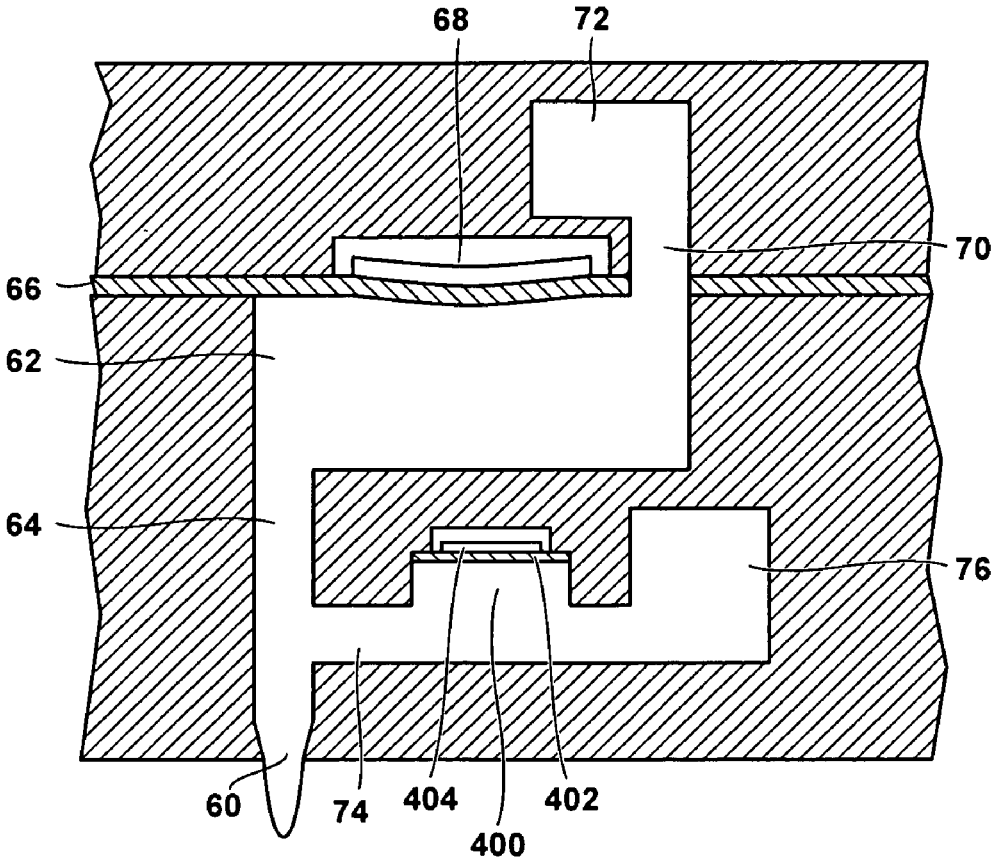
FIGS. 14A and 14B are illustrative diagrams of the action of the inkjet head according to the third embodiment.
Figure 14B:
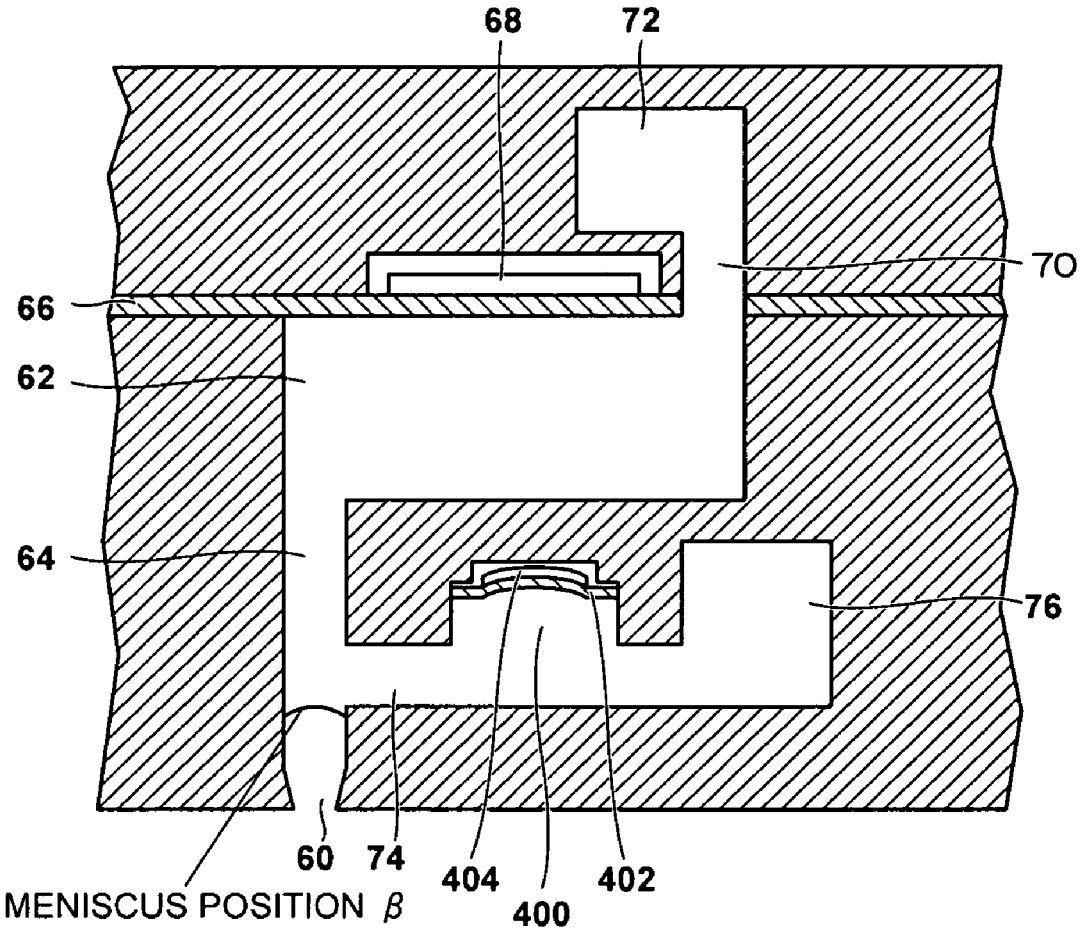

According to the inkjet head of the present embodiment which is composed as described above, when ejecting, as illustrated in FIG. 14A, the piezoelectric element 68 for the pressure chamber 62 is driven so as to eject ink from the nozzle 60, and when not ejecting, as illustrated in FIG. 14B, the suctioning piezoelectric element 404 of the suction chamber 400 is driven so as to withdraw the ink meniscus position from the vicinity of the nozzle (meniscus position α) to the vicinity of the connecting portion with the individual recovery flow channel 74 (the meniscus position β).

Control of Meniscus Position

Below, the method of controlling the ejection of ink by the inkjet head according to the present embodiment, including meniscus position control, will be described.

Figure 15:
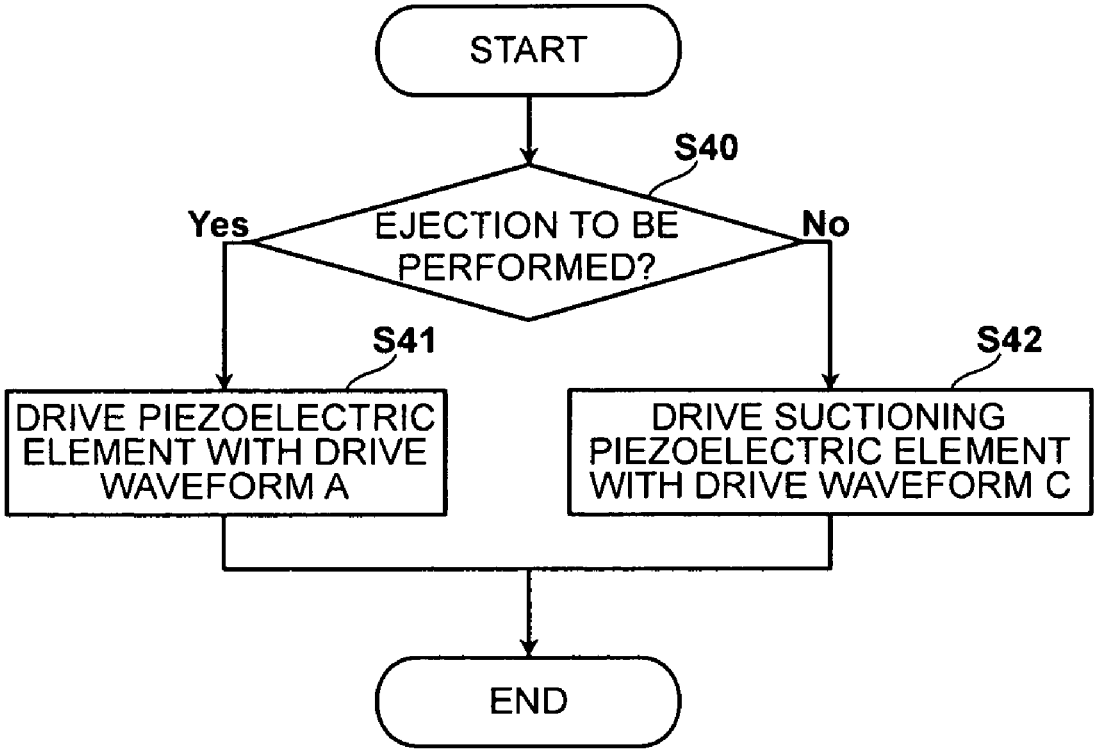
FIG. 15 is a flowchart showing steps of ink ejection control in one cycle in the inkjet head according to the third embodiment.

FIG. 15 is a flowchart showing steps for controlling ink ejection in one cycle, including control of the meniscus position.

Firstly, the system controller 100 judges whether or not ejection is to be performed (step S40).

If it is judged that ejection is to be performed, then the system controller 100 drives the piezoelectric element 68 with the drive waveform A. By this means, the ceiling surface of the pressure chamber 62 is displaced downwards by a prescribed amount, and the volume of the pressure chamber 62 is contracted by a prescribed amount. Consequently, as illustrated in FIG. 14A, an ink droplet of a prescribed ejection volume is ejected from the nozzle 60.

After ejection, the meniscus position of the ink inside the nozzle 60 is situated in the vicinity of the opening of the nozzle 60 (meniscus position α), as illustrated in FIG. 13.

On the other hand, if it is judged that ejection is not to be performed, then the system controller 100 drives the suctioning piezoelectric element 404 with a prescribed drive waveform C. Consequently, the ceiling surface of the suction chamber 400 is displaced upwards by a prescribed amount, and the volume of the suction chamber 400 is expanded by a prescribed amount. As a result of this, the ink inside the nozzle flow channel 64 is suctioned inside the suction chamber 400 via the individual recovery flow channel 74, and as illustrated in FIG. 14B, the ink meniscus position is withdrawn to the vicinity of the connecting portion with the individual recovery flow channel 74 (meniscus position β).

In this way, when performing ejection, the piezoelectric element 68 of the pressure chamber 62 is driven and ink is ejected from the nozzle 60 (see FIG. 14A), and when not performing ejection, the suctioning piezoelectric element 404 of the suction chamber 400 is driven and the ink meniscus position is withdrawn from the vicinity of the nozzle to the vicinity of the connecting portion with the individual recovery flow channel 74 (see FIG. 14B).

By this means, it is possible to withdraw the meniscus position of the ink to the vicinity of the connecting portion of the individual recovery flow channel 74, when not ejecting. By withdrawing the ink meniscus position to the vicinity of the connecting portion with the individual recovery flow channel 74 in this way, when not performing ejection, it is possible to prevent increase in the viscosity of the ink in the nozzle portion effectively.

As described above, in the inkjet head according to the present embodiment, the ink meniscus position is controlled during a recording operation, and when not performing ejection, the ink meniscus position is withdrawn to the vicinity of the connecting portion with the individual recovery flow channel 74, whereby it is possible to circulate the ink sufficiently and it is possible to prevent increase in the viscosity of the ink effectively, even when not ejecting ink.

Furthermore, according to the inkjet head of the present embodiment, since the piezoelectric element 68 and the suctioning piezoelectric element 404 are both displaced in the one direction to perform an ejection or suctioning operation, then it is possible to improve the durability of the piezoelectric elements.

The inkjet head according to the present embodiment differs from the inkjet head according to the first and second embodiments described above, in that a suctioning operation of the ink does not need to be carried out in the pressure chamber 62, and therefore it is possible to eject ink from the nozzle 60 by using another ejection method, such as a thermal method, or the like.

Fourth Embodiment of Inkjet Head

Figure 16:
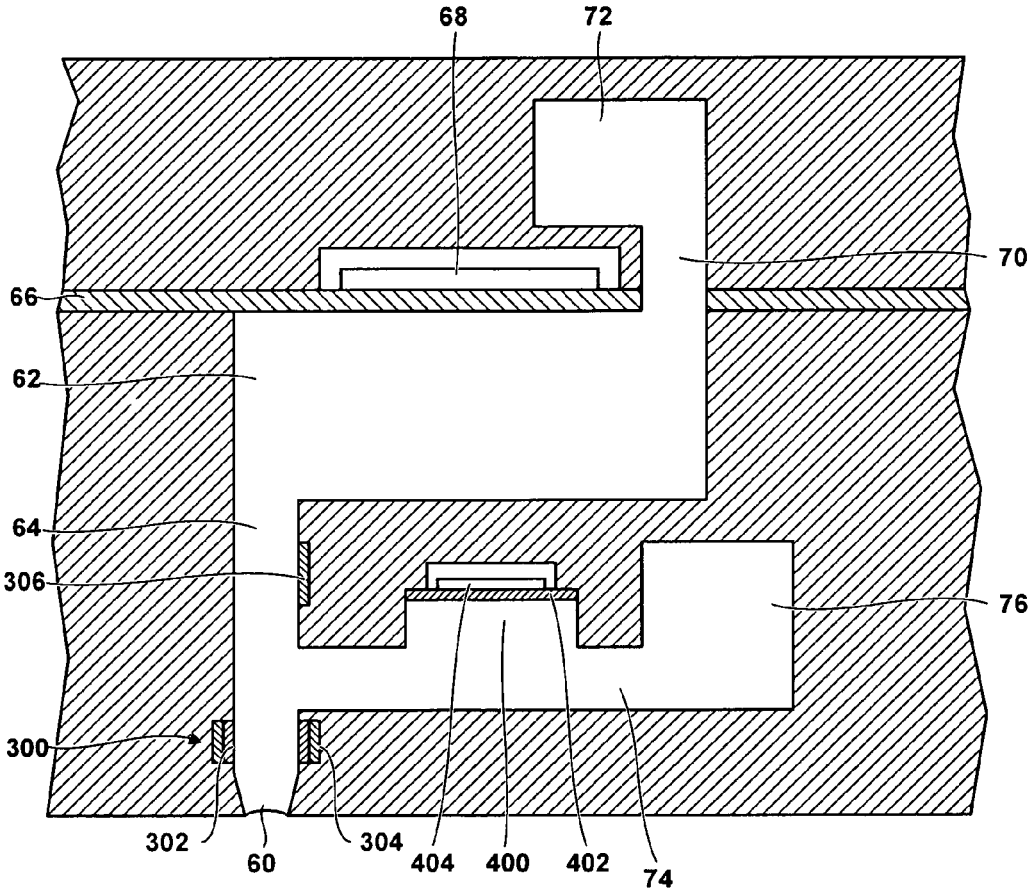
FIG. 16 is a vertical cross-sectional diagram illustrating the internal structure of an inkjet head according to a fourth embodiment.

FIG. 16 is a vertical cross-sectional diagram illustrating the internal structure according to an inkjet head relating to a fourth embodiment of the present invention.

As illustrated in FIG. 16, the inkjet head according to the present embodiment differs from the inkjet head according to the third embodiment which is described above in that it comprises a meniscus position holding device 300 inside the nozzle flow channel 64.

The composition of this meniscus position holding device 300 is the same as the meniscus position holding device 300 provided in the inkjet head according to the second embodiment which is described above (namely, the device is constituted by an inner surface properties switching member 302, a first electrode 304 and a second electrode 306, and the inner surface properties of the inner surface properties switching member 302 become hydrophobic when the passage of current between the first electrode 304 and the second electrode 306 is switched off, thereby holding the ink meniscus position which has been withdrawn inside the nozzle flow channel 64).

Consequently, only the method of controlling the ejection of ink by the inkjet head according to the present embodiment, including meniscus position control, will be described here.

Control of Meniscus Position

Figure 17:
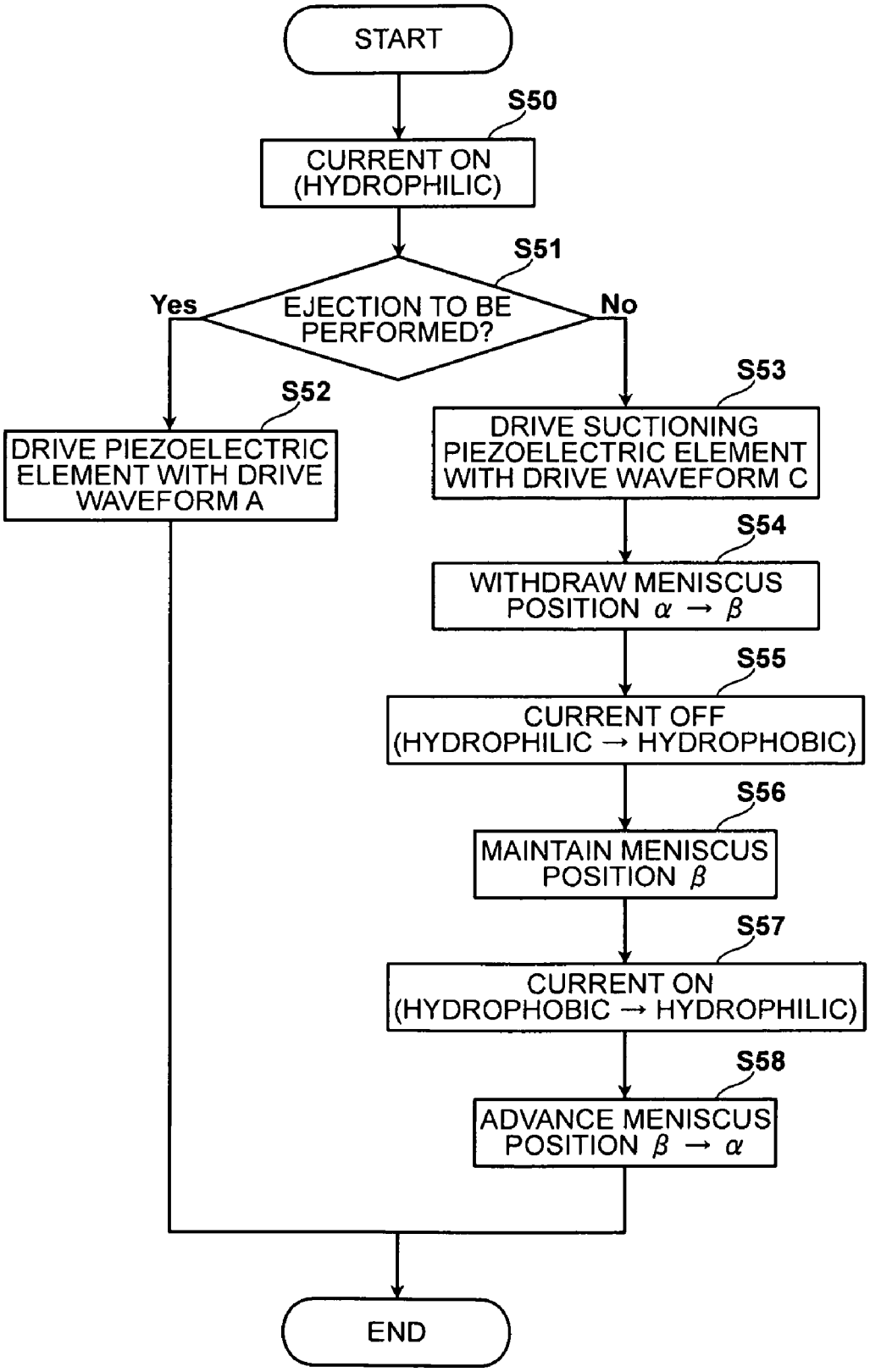
FIG. 17 is a flowchart showing steps of ink ejection control in one cycle in the inkjet head according to the fourth embodiment.

FIG. 17 is a flowchart showing steps for controlling ink ejection in one cycle, including control of the meniscus position, in an inkjet head according to the present embodiment.

Firstly, the system controller 100 applies a prescribed voltage between the first electrode 304 and the second electrode 306, and the passage of current between the first electrode 304 and the second electrode 306 is switched on (step S50). By this means, the inner surface properties of the inner surface properties switching member 302 are set to hydrophilic.

Next, the system controller 100 judges whether or not ejection is to be performed (step S51).

If, as a result of this, it is judged that ejection is to be performed, then the system controller 100 drives the piezoelectric element 68 with the drive waveform A (step S52). By this means, the ceiling surface of the pressure chamber 62 is displaced downwards by a prescribed amount, and the volume of the pressure chamber 62 is contracted by a prescribed amount. Consequently, an ink droplet of a prescribed ejection volume is ejected from the nozzle 60 (see FIG. 14A). In this case, the ink is ejected in a state where the inner surface properties of the inner surface properties switching member 302 are hydrophilic.

After ejection, the ink meniscus position inside the nozzle 60 is situated in the vicinity of the opening of the nozzle 60 (meniscus position α).

On the other hand, if it is judged that ejection is not to be performed, then the system controller 100 drives the suctioning piezoelectric element 404 with a prescribed drive waveform C (step S53). Consequently, the ceiling surface of the suction chamber 400 is displaced upwards by a prescribed amount, and the volume of the suction chamber 400 is expanded by a prescribed amount. As a result of this, the ink inside the nozzle flow channel 64 is suctioned from the individual recovery flow channel 74 toward the suction chamber 400, and the ink meniscus position is withdrawn to the vicinity of the connecting portion with the individual recovery flow channel 74 (meniscus position β) (see FIG. 14B). In other words, the ink meniscus is withdrawn from the meniscus position α in the vicinity of the opening of the nozzle 60 to the meniscus position β in the vicinity of the connecting portion with the individual recovery flow channel 74 (step S54). In this case, the ink is drawn back inside the pressure chamber 62 in a state where the inner surface properties of the inner surface properties switching member 302 are hydrophilic.

The system controller 100 then sets the voltage applied between the first electrode 304 and the second electrode 306 to zero, and the passage of current between the first electrode 304 and the second electrode 306 is switched off (step S55). By this means, the inner surface properties of the inner surface properties switching member 302 are switched to hydrophobic. By switching the inner surface properties of the inner surface properties switching member 302 to hydrophobic in this way, the ink meniscus position which has been withdrawn to the meniscus position β in the vicinity of the connecting portion with the individual recovery flow channel 74 is held stably in the meniscus position β in the vicinity of the connecting portion with the individual recovery flow channel 74 (step S56).

In accordance with the end of the non-ejection step, the system controller 100 applies a prescribed voltage between the first electrode 304 and the second electrode 306, and the passage of current between the first electrode 304 and the second electrode 306 is switched on (step S57). By this means, the inner surface properties of the inner surface properties switching member 302 are switched to hydrophilic. By switching the inner surface properties of the inner surface properties switching member 302 to hydrophilic, the meniscus position holding function performed by the inner surface properties switching member 302 is lost, the voltage of the drive waveform B becomes zero, and the meniscus position advances (descends) to the vicinity of the original nozzle opening portion (meniscus position α) (step S58).

In this way, in the inkjet head according to the present embodiment, the ink meniscus position is withdrawn to the vicinity of the connecting portion with the individual recovery flow channel 74 when not performing ejection, and the meniscus position thus withdrawn is held by the meniscus position holding device 300. By this means, it is possible to hold the withdrawn meniscus position stably, and increase in the viscosity of the ink can be prevented more effectively.

By providing a meniscus position holding device 300 as in the inkjet head according to the present embodiment, it is possible to hold the withdrawn meniscus position stably over a long period of time.

Therefore, in the inkjet head according to the present embodiment, similarly to the inkjet head according to the second embodiment described above, it is desirable to withdraw the ink meniscus position to the vicinity of the connecting portion of the individual recovery flow channel 74 at all times, when not performing a recording operation (the meniscus is desirably maintained at the meniscus position β).

Other Embodiments

In the series of embodiments described above, a case where the present invention is applied to a line head is described, but the present invention can also be applied similarly to a shuttle head.

Furthermore, in the series of embodiments described above, the ceiling face of the pressure chamber 62 is displaced in the upward/downward direction and the volume of the pressure chamber 62 is thereby expanded or contracted, but the face which is displaced is not limited to this. The same applies to the suction chambers.

Figure 18:
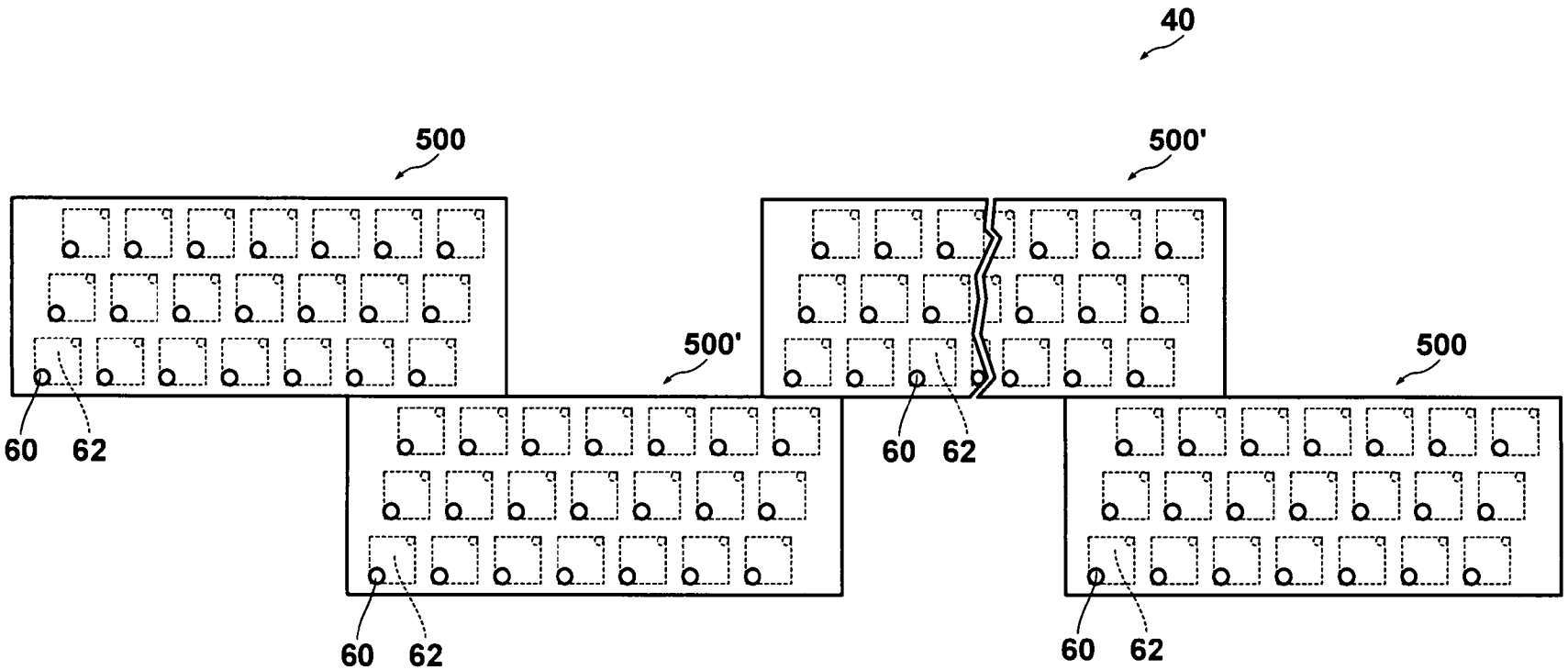
FIG. 18 is a plan view perspective diagram illustrating an inkjet head according to a further embodiment.

Furthermore, in the series of embodiments described above, a line head is composed by arranging nozzles in a matrix configuration in one head block which is composed in a long shape, but as illustrated in FIG. 18, it is also possible to compose a line head corresponding to the paper width by joining together a plurality of short head blocks 500 in a matrix configuration, each head block having nozzles 60 arranged in a matrix configuration. Furthermore, although not illustrated in the drawings, it is also possible to compose a line head by arranging short heads with the nozzles in one row.

Furthermore, in the inkjet recording apparatus according to the present embodiment, a composition is described in which an image is recorded by using inks of seven colors, namely, C, M, Y, K, R, G and B, but the number of inks used is not limited to this. For example, in addition to this, it is also possible to adopt a composition which forms an image by using inks of four colors: C, M, Y and K.

Moreover, in the series of embodiments described above, a face of the pressure chamber (in the present examples, a ceiling face) is displaced by a piezoelectric element, but the device (actuator) which displaces a face of the pressure chamber is not limited to this.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet head, comprising:

a pressure chamber;

an actuator which expands and contracts volume of the pressure chamber;

an ink supply flow channel;

an individual supply flow channel having one end connected to the ink supply flow channel and another end connected to the pressure chamber, for guiding ink from the ink supply flow channel to the pressure chamber;

a nozzle which ejects the ink;

a nozzle flow channel having one end connected to the pressure chamber and another end connected to the nozzle, for guiding the ink from the pressure chamber to the nozzle;

an ink recovery flow channel;

an individual recovery flow channel having one end connected to the nozzle flow channel at a prescribed connection position set at an intermediate point of the nozzle flow channel and another end connected to the ink recovery flow channel, for guiding the ink from the nozzle flow channel to the ink recovery flow channel;

an ink flow generation device which generates a flow of the ink from the nozzle flow channel toward the individual recovery flow channel; and a control device which controls driving of the actuator so as to drive the actuator in such a manner that, when performing ejection, volume of the pressure chamber contracts and thereby the ink is caused to be ejected from the nozzle, and when not performing the ejection, the volume of the pressure chamber expands and thereby a meniscus position of the ink is caused to be withdrawn to a vicinity of the prescribed connection position, thereby to circulate the ink sufficiently to suppress an increase in the viscosity of the ink.

2. The inkjet head as defined in claim 1, wherein:

the actuator is a piezoelectric element which displaces a wall of the pressure chamber in two directions so as to expand or contract the volume of the pressure chamber; and the control device drives the actuator by a first drive waveform signal to eject the ink from the nozzle when performing the ejection, and drives the actuator by a second drive waveform signal to withdraw the meniscus position of the ink to the vicinity of the prescribed connection position when not performing the ejection.

3. The inkjet head as defined in claim 1, further comprising an inner surface properties switching device which selectively switches inner surface properties of the nozzle flow channel in the vicinity of the connection position between hydrophobic and hydrophilic, wherein the control device controls the inner surface properties switching device in such a manner that the inner surface properties are switched to hydrophilic when performing the ejection and are switched to hydrophobic when not performing the ejection.

4. The inkjet head as defined in claim 3, wherein the inner surface properties switching device comprises:

a ring-shaped hydrophobic insulating body which constitutes an inner surface of the nozzle flow channel in the vicinity of the connection position;

a ring-shaped electrode provided on an outer circumferential portion of the ring-shaped hydrophilic insulating body; and a voltage application device which applies voltage between the ink flowing in the nozzle flow channel and the electrode, wherein an inner surface of the ring-shaped hydrophobic insulating body becomes hydrophilic when the voltage application device applies the voltage between the ink and the electrode, and becomes hydrophobic when application of the voltage by the voltage application device is cancelled.

5. The inkjet head as defined in claim 1, wherein:

the ink in the ink supply flow channel is supplied from an ink tank;

the ink in the ink recovery flow channel is recovered to the ink tank; and the ink flow generation device circulates the ink so as to generate the flow of the ink from the nozzle flow channel toward the individual recovery flow channel.

6. An inkjet head, comprising:

a pressure chamber;

an ejection actuator which changes pressure in the pressure chamber;

an ink supply flow channel;

an individual supply flow channel having one end connected to the ink supply flow channel and another end connected to the pressure chamber, for guiding ink from the ink supply flow channel to the pressure chamber;

a nozzle which ejects ink;

a nozzle flow channel having one end connected to the pressure chamber and another end connected to the nozzle, for guiding the ink from the pressure chamber to the nozzle;

an ink recovery flow channel;

an individual recovery flow channel having one end connected to the nozzle flow channel at a prescribed connection position set at an intermediate point of the nozzle flow channel and another end connected to the ink recovery flow channel, for guiding the ink from the nozzle flow channel to the ink recovery flow channel;

an ink flow generation device which generates a flow of the ink from the nozzle flow channel to the individual recovery flow channel; and a suction chamber which is provided at an intermediate point of the individual recovery flow channel;

a suctioning actuator which expands volume of the suction chamber; and a control device which controls driving of the suctioning actuator so as to drive the suctioning actuator in such a manner that, when not performing ejection, the volume of the suction chamber is expanded to withdraw a meniscus position of the ink to a vicinity of the prescribed connection position.

7. The inkjet head as defined in claim 6, further comprising an inner surface properties switching device which selectively switches inner surface properties of the nozzle flow channel in the vicinity of the connection position between hydrophobic and hydrophilic, wherein the control device controls the inner surface properties switching device in such a manner that the inner surface properties are switched to hydrophilic when performing the ejection and are switched to hydrophobic when not performing the ejection.

8. The inkjet head as defined in claim 7, wherein the inner surface properties switching device comprises:

a ring-shaped hydrophobic insulating body which constitutes an inner surface of the nozzle flow channel in the vicinity of the connection position;

a ring-shaped electrode provided on an outer circumferential portion of the ring-shaped hydrophilic insulating body; and a voltage application device which applies voltage between the ink flowing in the nozzle flow channel and the electrode, wherein an inner surface of the ring-shaped hydrophobic insulating body becomes hydrophilic when the voltage application device applies the voltage between the ink and the electrode, and becomes hydrophobic when application of the voltage by the voltage application device is cancelled.

9. The inkjet head as defined in claim 6, wherein:

the ejection actuator is a piezoelectric element which deforms a wall of the pressure chamber in one direction to expand volume of the pressure chamber; and the suctioning actuator is a piezoelectric element which deforms a wall of the suction chamber in one direction to contract the volume of the suction chamber.

10. The inkjet head as defined in claim 6, wherein:

the ink in the ink supply flow channel is supplied from an ink tank;

the ink in the ink recovery flow channel is recovered to the ink tank; and the ink flow generation device circulates the ink so as to generate the flow of the ink from the nozzle flow channel toward the individual recovery flow channel.

* * * * *